US011014107B2

(12) United States Patent
Alluigi

(10) Patent No.: US 11,014,107 B2
(45) Date of Patent: May 25, 2021

(54) CONNECTION SYSTEM

(71) Applicant: GUALA DISPENSING S.P.A., Alessandria (IT)

(72) Inventor: Riccardo Alluigi, Alessandria (IT)

(73) Assignee: Guala Dispensing S.P.A., Alessandria (IT)

( * ) Notice: Subject to any disclaimer, the term of this patent is extended or adjusted under 35 U.S.C. 154(b) by 0 days.

(21) Appl. No.: 16/753,116

(22) PCT Filed: Sep. 28, 2018

(86) PCT No.: PCT/IB2018/057536
§ 371 (c)(1),
(2) Date: Apr. 2, 2020

(87) PCT Pub. No.: WO2019/092517
PCT Pub. Date: May 16, 2019

(65) Prior Publication Data

US 2020/0261934 A1 Aug. 20, 2020

(30) Foreign Application Priority Data

Nov. 7, 2017 (IT) ..... 102017000126215

(51) Int. Cl.
*B05B 11/00* (2006.01)

(52) U.S. Cl.
CPC ..... *B05B 11/001* (2013.01); *B05B 11/3011* (2013.01)

(58) Field of Classification Search
CPC ..... B05B 11/001; B05B 11/3045; B05B 11/3011; B05B 11/3077; B05B 11/0029; B05B 11/3074
USPC ..... 222/401, 489, 383.1, 153.01, 153.13; 215/216–220, 223, 224, 316, 201, 318; 220/300, 296, 293, 288, 345.1, 345.2
See application file for complete search history.

(56) References Cited

U.S. PATENT DOCUMENTS 4,335,823 A * 6/1982 Montgomery ..... B65D 50/048 215/206
5,551,582 A * 9/1996 Robinson ..... B65D 50/048 215/216
5,725,132 A * 3/1998 Foster ..... B05B 11/001 222/383.1

(Continued)

FOREIGN PATENT DOCUMENTS

CN 103272731 A 9/2013
EP 0867230 A2 9/1998

(Continued)

OTHER PUBLICATIONS

International Search Report for International Patent Application No. PCT/IB2018/057536, dated Jan. 31, 2019. 3 pages.

(Continued)

*Primary Examiner* — Vishal Pancholi
(74) *Attorney, Agent, or Firm* — Armstrong Teasdale LLP

(57) ABSTRACT

A connection system between a trigger dispensing head and a bottle of a dispensing device is provided. The neck of the bottle and the skirt of the trigger dispensing head are engageable with each other exclusively in a relevant pre-defined angular position, wherein the axial snap-engagement between the skirt and the neck is allowed.

16 Claims, 16 Drawing Sheets

(56) References Cited

U.S. PATENT DOCUMENTS

| | | | | |
|---|---|---|---|---|
| 5,810,209 | A * | 9/1998 | Foster | B05B 11/001 215/332 |
| 6,138,873 | A * | 10/2000 | Gramola | B65D 41/47 222/153.14 |
| 7,478,739 | B2 * | 1/2009 | Foster | B05B 11/3011 222/383.1 |
| 7,841,491 | B2 * | 11/2010 | Contiero | B05B 11/001 222/383.1 |
| 7,980,427 | B2 * | 7/2011 | Contiero | B05B 11/3045 222/383.1 |
| 2008/0257913 | A1 * | 10/2008 | Contiero | B05B 11/001 222/383.1 |
| 2011/0108581 | A1 | 5/2011 | Dennis | |
| 2014/0069962 | A1 | 3/2014 | Dennis | |
| 2016/0214130 | A1 * | 7/2016 | Alluigi | B05B 15/30 |

FOREIGN PATENT DOCUMENTS

| | | | |
|---|---|---|---|
| EP | 1982770 | A2 | 10/2008 |
| WO | 2012092989 | A1 | 7/2012 |

OTHER PUBLICATIONS

First Office Action and Search Report in related Chinese Patent Application No. 201880069030.4, dated Feb. 26, 2021, 10 pages (34 pages with English Translation).

* cited by examiner

CONNECTION SYSTEM

CROSS-REFERENCE TO RELATED APPLICATIONS

This application is a National Stage Application of International Patent Application No. PCT/IB2018/057536, having an International Filing Date of Sep. 28, 2018, which claims the benefit of priority to Italian Patent Application No. 102017000126215, filed Nov. 7, 2017, the entire contents of which are hereby incorporated by reference herein.

FIELD OF THE INVENTION

The present invention is in the field of trigger dispensing devices; in particular, the object of the present invention is a connection system between a dispensing head and a bottle of the trigger dispensing device.

STATE OF THE ART

As is known, such dispensing devices are today enormously widespread in various fields: home hygiene, air fresheners, fabric treatment with stain removers or before ironing, gardening, and many others. Every year, millions of dispensing heads and bottles are produced.

In a filling system, the bottles are filled with the desired liquid, for example a detergent, and highly automated machines are used to fit the dispensing head to the respective bottle.

It is therefore essential that the connection system between the dispensing head and the bottle permits a rapid, effective and reliable application.

For this purpose, bayonet connection systems are particularly effective. An example of embodiment is illustrated in EP-A2-0867230 and EP-A2-1982770 in the name of the Applicant.

Moreover, more and more often, the dispensing devices are reusable so as to be filled by the user with the desired product, purchased in refill packs.

The connection system between the dispensing head and the bottle must therefore be reversible, in the sense that the user must be able to easily separate the head from the bottle, to fill the bottle and reattach the head.

However, it has been found, also through surveys and the collection of consumer reports, that the average user faces considerable difficulties in correctly reattaching the dispensing head onto the bottle.

Such problem is evident especially in dispensing devices for which, in order to be properly fitted, the head and neck must be in a predefined mutual angular position, while the connection system in itself would permit coupling in multiple relevant positions.

OBJECT OF THE INVENTION

The object of the present invention is to create a connection system between a trigger dispensing head and the neck of a bottle of the bayonet type, which permits the head to be fitted to the neck only when the head and bottle are in a relevant predefined and univocal angular position.

Such object is achieved by a connection system having the features described below. Advantageous embodiments of the invention are also described.

The features and advantages of the connection system according to the present invention will be apparent from the description given below, provided by way of non-limiting example.

BRIEF DESCRIPTION OF THE DRAWINGS

FIGS. 2*a* to 5*a* and 2*b* to 5*b* represent respectively a bottle of the dispensing device and an enlargement of a neck of the bottle, according to an initial embodiment of the invention, according to different points of observation.

DETAILED DESCRIPTION OF THE INVENTION

Figure 1B:
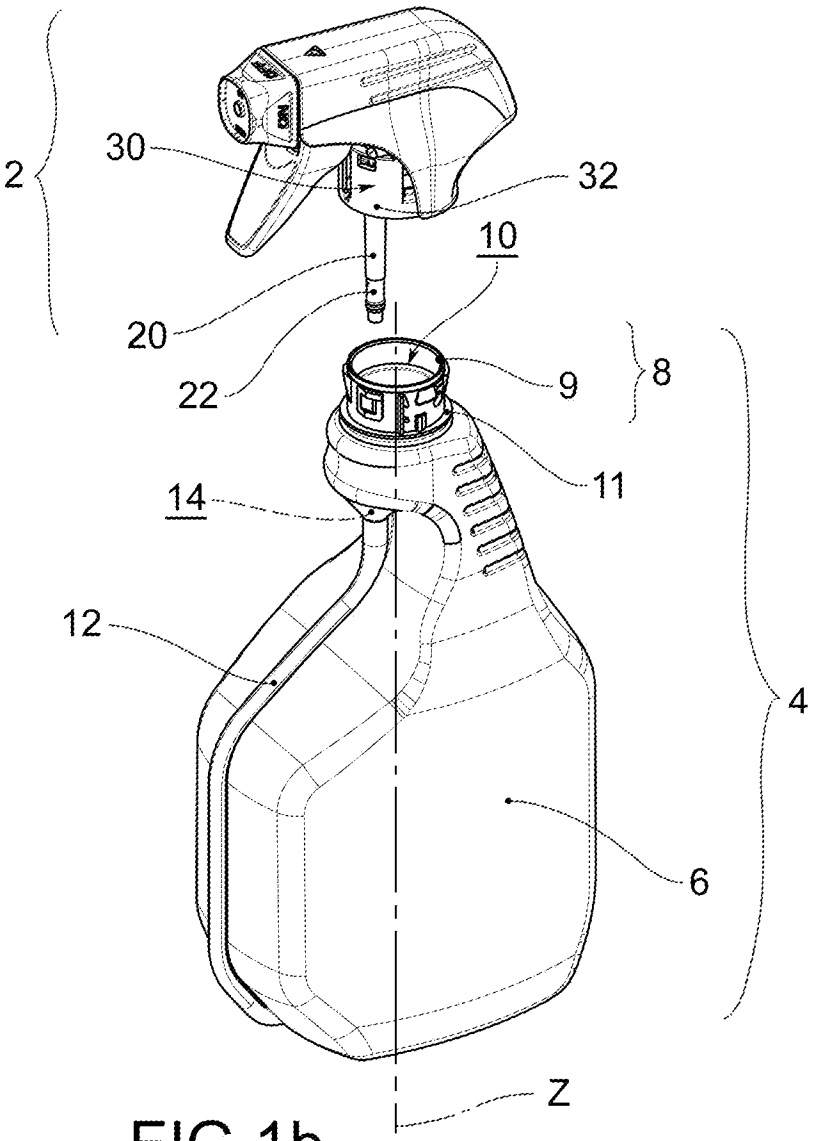
FIGS. 1*a* and 1*b* show a dispensing device according to an embodiment of the present invention, respectively in a configuration of use and in separate parts.
Figure 1A:
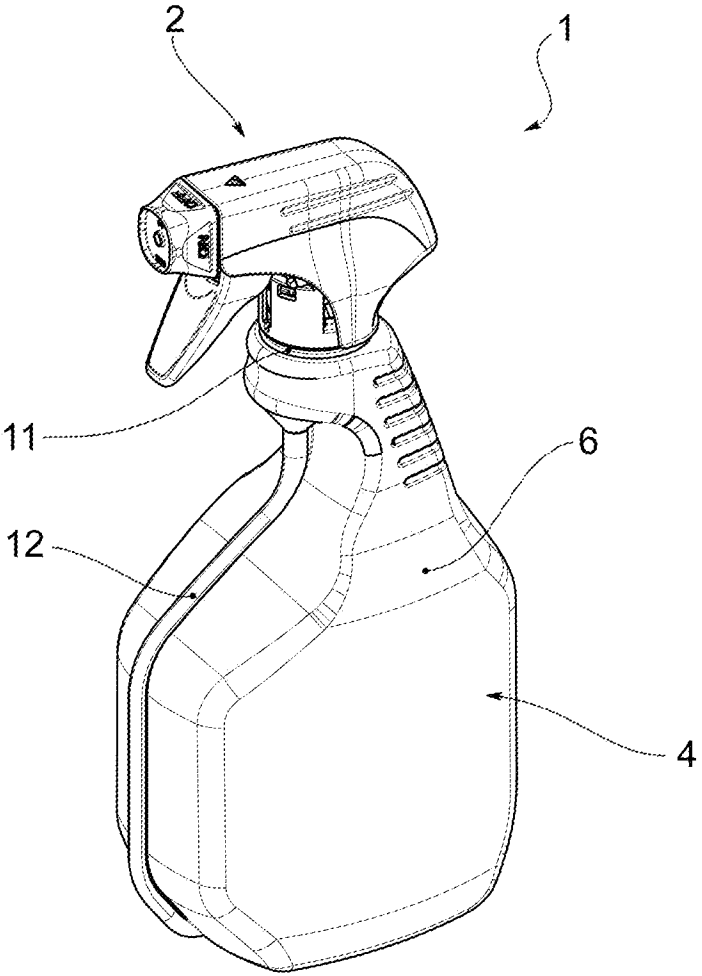

With reference to FIGS. 1*a* and 1*b*, a trigger dispensing device comprising a trigger dispensing head 2 and a bottle 4, to which the head 2 may be firmly fitted, is collectively indicated at 1.

The bottle 4 consists of a bottle body 6, closed at the bottom, and a neck 8 having a free edge 9 which delimits a circular bottle mouth 10, having a central axis Z.

The neck 8 extends axially from said free edge 9, placed at the top, to an annular flange 11, placed at the bottom, protruding radially externally.

According to a preferred embodiment, the bottle 4 is equipped with a suction tube 12 in a single piece with the bottle body 6, for example, arranged externally thereto, on the front.

The suction tube 12 is open at the bottom of the body of the bottle 6 in order to suck up the product to be dispensed and is open at the top by means of an engagement opening 14, on the part of the neck 8, inside the bottle 4.

Preferably, the engagement opening is arranged in the bottle body 6, i.e. below the neck 8, for example, offset with respect to the central axis Z.

The head 4 comprises a main tube 20, for example equipped with an end section 22 made of flexible material, intended to be engaged with the suction tube 12 to be sealingly inserted into the engagement opening 14.

After the head 2 has been separated from the bottle 4, for example to fill the bottle, it is necessary to reattach the head to the neck so that the main tube 20 enters into the engagement opening 14.

Since the engagement opening 14 is offset from the central axis Z, it is essential that the head 2 may be fitted to the neck 8 of the bottle 2 when said head and said neck are in a relevant predefined univocal angular position, to which corresponds the insertion of the main tube 20 in the engagement opening 14.

The head 2 comprises a frame 30, typically made as a single piece, which supports the functional components of said head, such as a trigger, a piston, valve means, a nozzle and the like; preferably, moreover, said frame comprises portions that define additional functional parts of the head, such as a dispensing conduit, a pressure chamber for the piston, and the like.

In particular, the frame 30 comprises an annular skirt 32 consisting of a wall that, when the head is fitted to the neck, is coaxial with the main axis Z.

A connection system according to the present invention comprises the neck 8 of the bottle 4 and the skirt 32 of the frame 30, suitable to engage each other, with axial overlap, by snap-engagement and according to a bayonet connection.

Two-Catch Connection

A first embodiment of the connection system provides for a two-catch connection.

In such embodiment, the two catches are arranged in diametrically opposed positions, and therefore angularly distant by 180°.

Two-Catch Connection Neck

The neck 8 has externally a cylindrical circular outer surface 8*a* having a width equal to the distance between the free edge 9 and the annular flange 11.

For said outer surface 8*a*, an upper band 8' is defined extending axially between the free edge 9 and an imaginary separation line 8*, and a lower band 8" extending from said separation line 8* to the annular flange 11. Preferably, said separation line 8* lies on a plane perpendicular to the main axis Z.

On the outer surface 8*a* of the neck 8 a reference region 100 is defined, which comprises a circumferential section of the outer surface 8*a*.

Figure 2B:
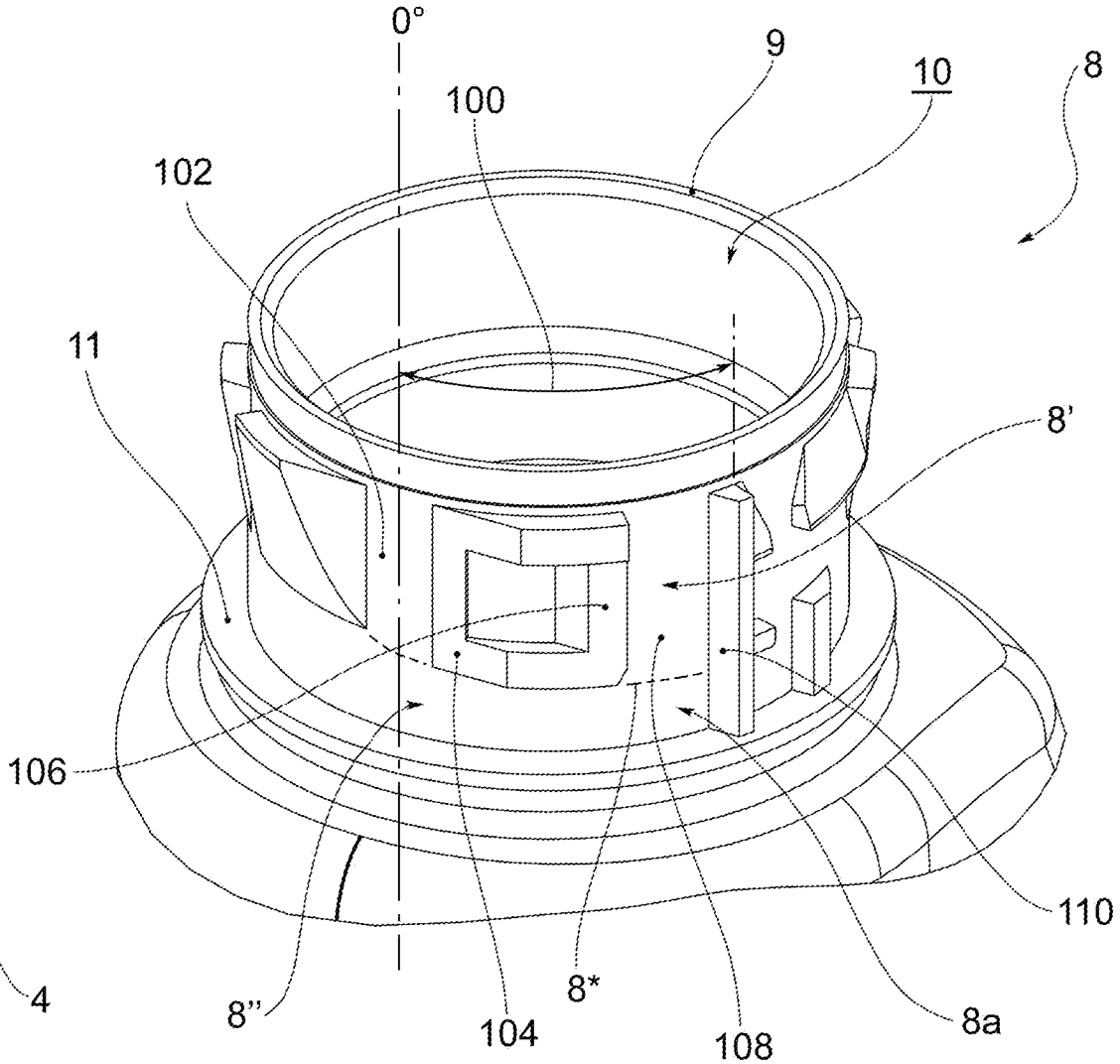
Figure 2A:
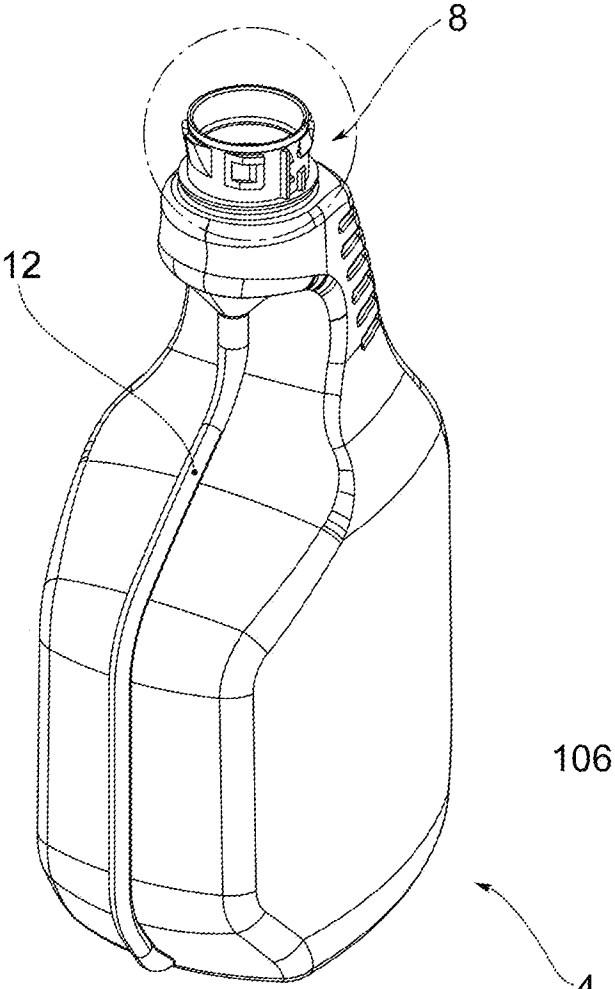

With reference to FIGS. 2*a* and 2*b*, the reference region 100 of the neck 8 has an axial reference passage 102 extending from the free edge 9 to the annular flange 11 and defining a reference for properly fitting the head 2.

Circumferentially proceeding on the outer surface 8*a* of the neck 8 in a predefined direction of travel A, for example counterclockwise, the reference passage 102 is flanked circumferentially by reference ramps 104*a*, 104*b*, inclined towards the reference passage 102, mainly contained in the upper band 8', to facilitate the engagement with the skirt of the frame.

Preferably, the reference ramp 104*a* is followed by a reference plane 106, also contained in the first band 8', connected to the reference ramp 104*a*, at the top thereof.

Proceeding in the same direction of travel, the reference region 100 has an axial reference exit passage 108, flanked by the reference plane 106, which extends from the free edge 9 to the annular flange 11.

Still proceeding in the same direction of travel, the reference region 100 has a reference rib 110, flanked by the reference exit passage 108.

Preferably, said reference rib 110 extends from the free edge 9 to the annular flange 11 and consists of a wall protruding from the outer surface 8*a*, having extension parallel to a generatrix of the cylindrical outer surface 8*a*.

Figure 3B:
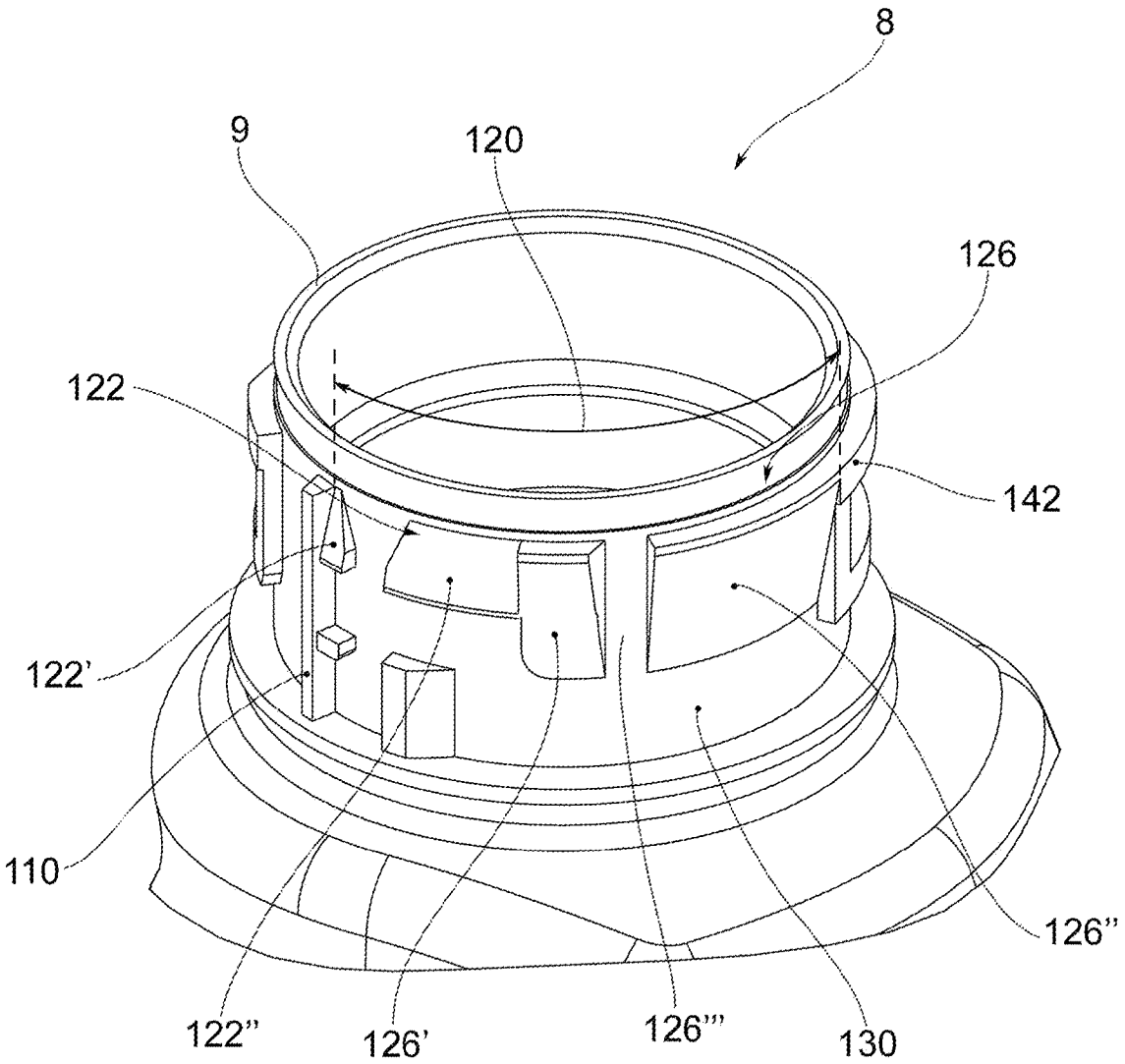
Figure 3A:
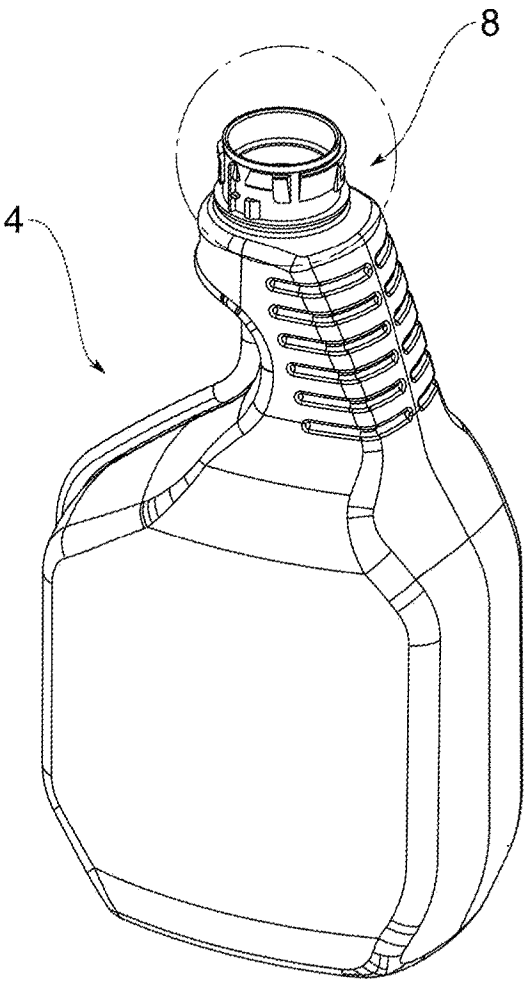

With reference to FIGS. 3*a* and 3*b*, flanking the guide region 100 in said direction of travel A, the outer surface 8*a* has a first catch region 120, comprising a subsequent circumferential section of said outer surface 8*a*.

The first catch region 120 has a first catch guide 122, flanking the reference rib 110, preferably joined thereto, contained in the first band 8' of the outer surface 8*a*.

Said first catch guide 122 consists of two sloping walls 122', 122", of increasing thickness from the free edge 9 towards the annular flange 11, separated circumferentially by a first funnel-shaped catch entry passage 122'''.

Below the first catch guide 122, preferably entirely contained in the upper band 8", there is a surface without any ridges that defines a first circumferential catch pocket 124, into which flows the first catch entry passage 122'''.

Proceeding in the direction of travel A, the first catch region 120 provides for a first catch slide 126, having extension in the upper band 8', flanking, in particular joined to, the first catch guide 122.

The first catch slide 126 has a decreasing thickness from the free edge 9 towards the annular flange 11, and consists of two slide parts 126', 126" separated circumferentially, so as to define a first axial catch exit passage 126''', contained in the upper band 8'.

Axially, the first catch slide 126 extends beyond the first catch guide 122, so as to flank at least partially the first catch pocket 124.

On the side of the free edge 9, said first catch slide 126 has a first catch slide abutment 128, divided into two abutment parts 128', 128" from said first catch exit passage 126'''.

Said first catch slide abutment 128 coincides with an abutment portion of the first catch slide or constitutes an element protruding radially with respect thereto.

Axially, the first catch slide 126 ends before the annular flange 11; preferably, said first catch slide 126 is contained in the upper band 8".

Consequently, between the first catch slide 126 and the annular flange 11, an area without any ridges is formed, which constitutes a first catch corridor 130 extending circumferentially.

Figure 4B:
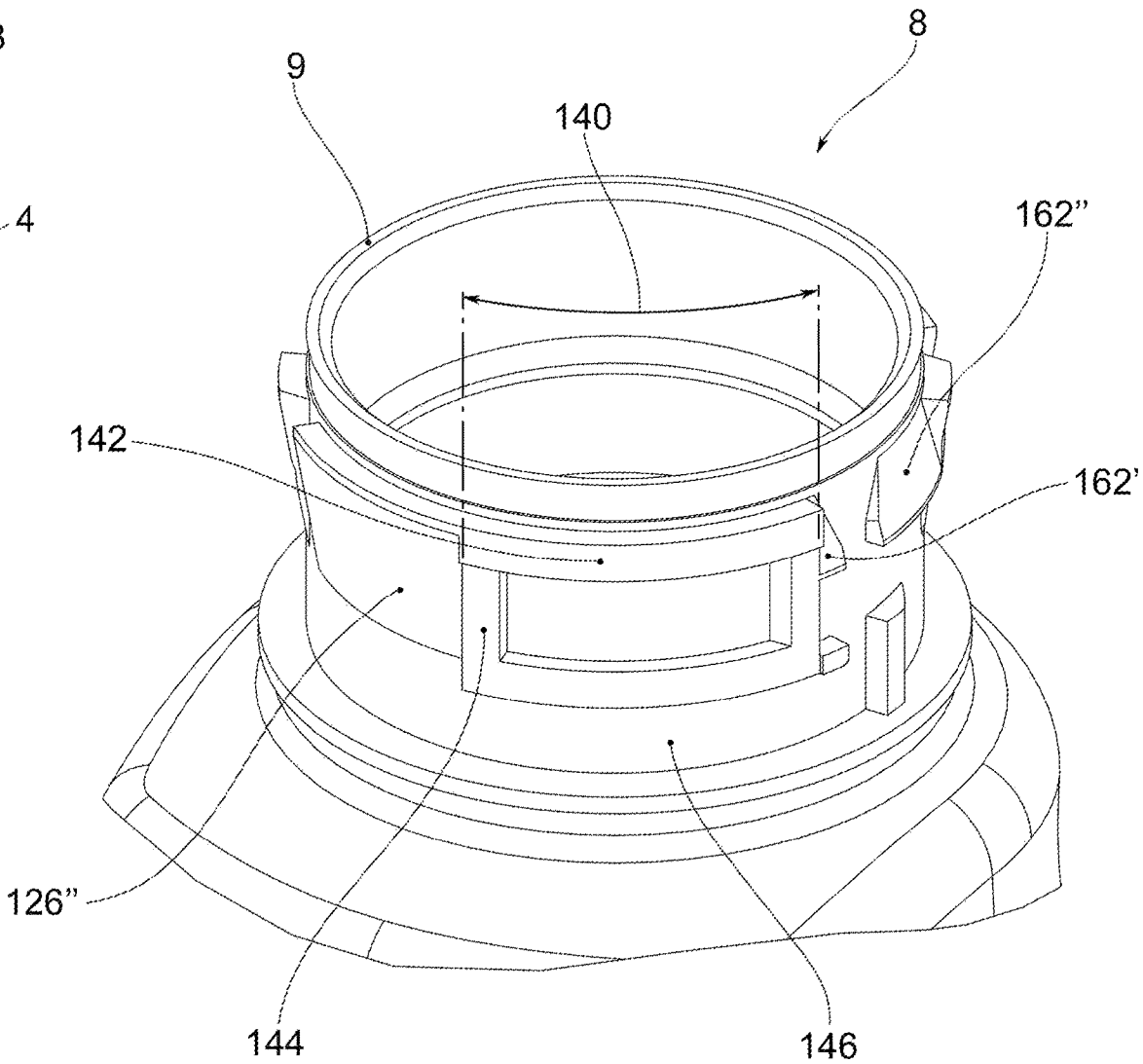
Figure 4A:
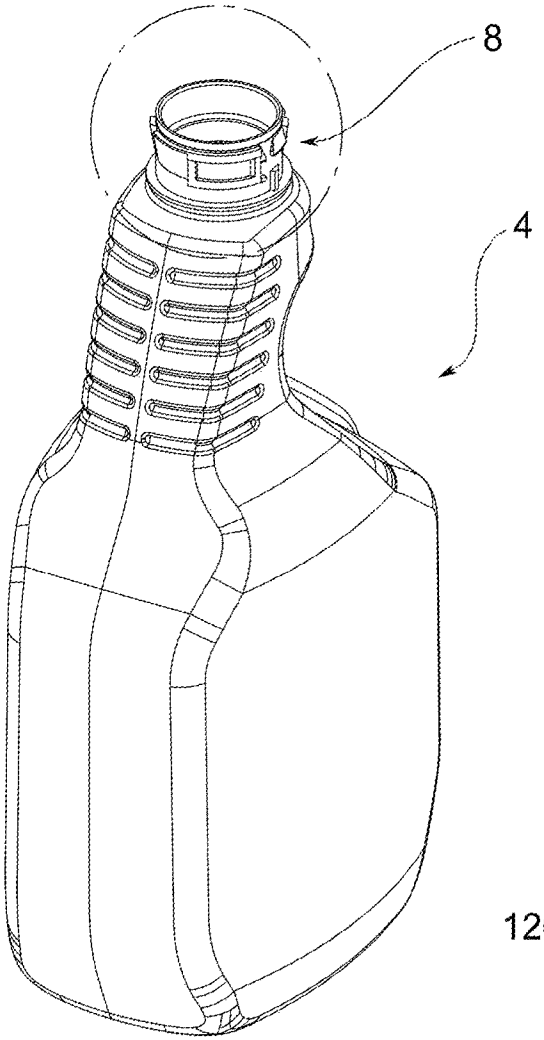

With reference to FIGS. 4*a* and 4*b*, flanking the first catch region 120, in said direction of travel A, the outer surface 8*a* has a first shelf region 140, comprising a subsequent circumferential section of said outer surface 8*a*.

The shelf region 140 comprises an upper shelf 142, located near the free edge 9, for example, substantially aligned circumferentially with the entry of the first catch slide 126.

Preferably, said upper shelf 142 protrudes radially from the outer surface 8*a* and is aligned with the first catch slide abutment 128.

Preferably, the shelf region 140 further comprises a shelf stop 144, flanking circumferentially the first catch slide 126, having axial extension mainly in the upper band 8'.

The shelf stop 144 ends before the annular flange 11, thus leaving a region free from ridges, which constitutes a circumferential shelf corridor 146.

Figure 5B:
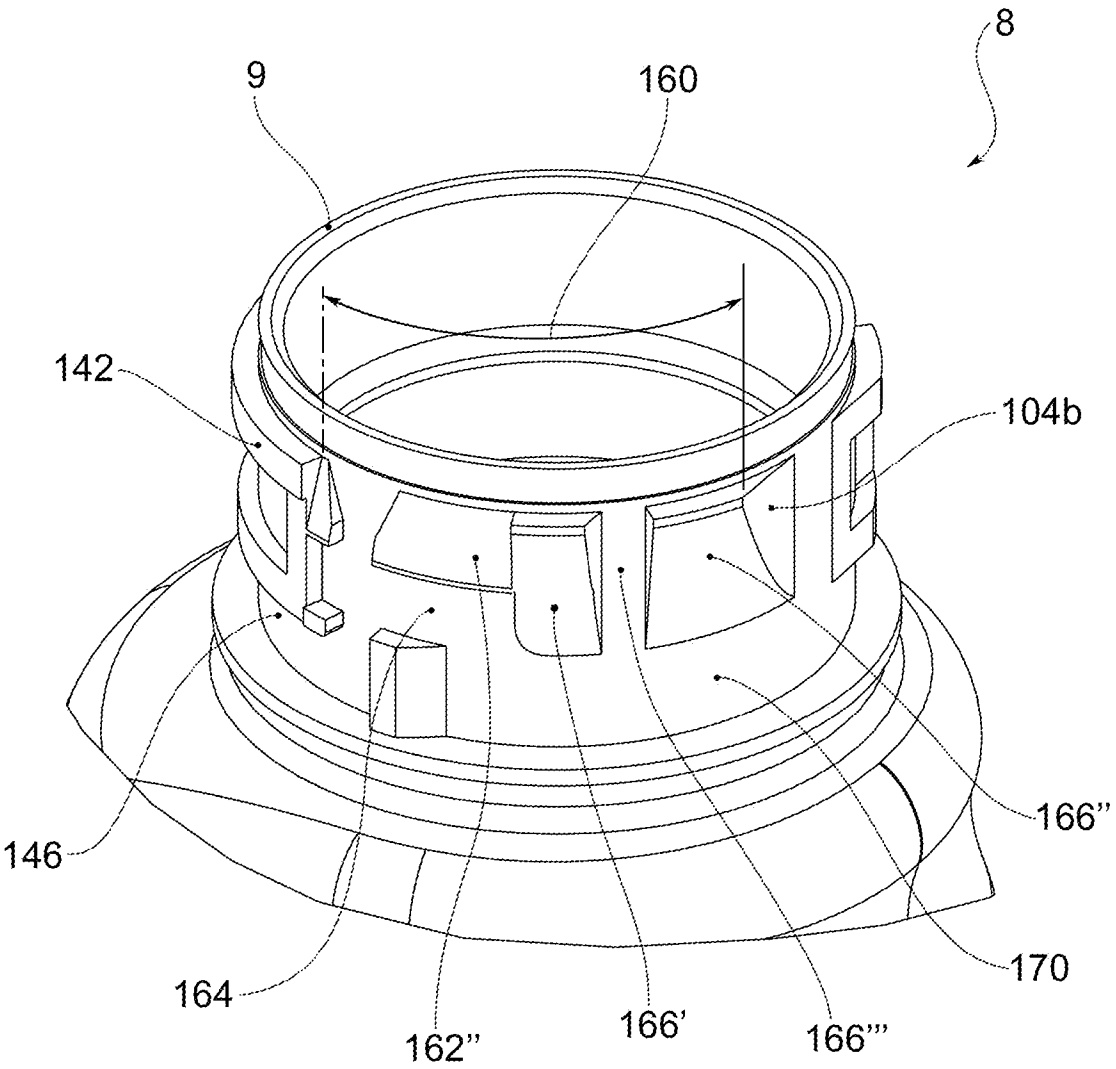
Figure 5A:
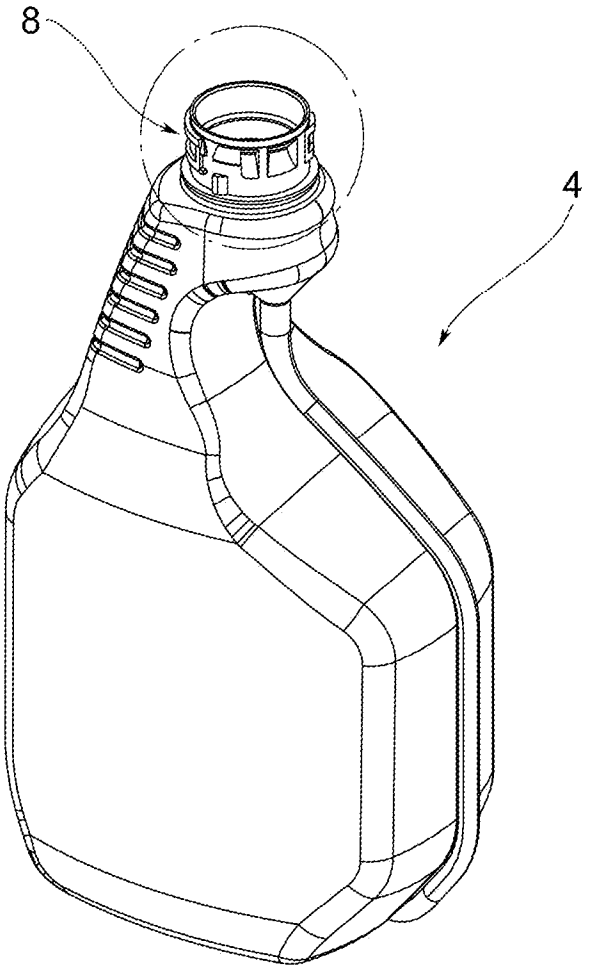

With reference to FIGS. 5*a* and 5*b*, flanking the first shelf region 140, in said direction of travel A, the outer surface 8*a* has a second catch region 160, comprising a subsequent circumferential section of said outer surface 8*a*, structurally and functionally similar to the first catch region 120.

In particular, said second catch region 160 comprises:

- a second catch guide 162, consisting of two sloping walls 162', 162" separated by a second catch entry passage 162'";
- a second catch pocket 164;
- a second catch slide 166, consisting of two slide parts 166', 166" separated by a second catch exit passage 166'", with a second catch slide abutment 168, divided into two abutment parts 168', 168";
- a second catch corridor 170.

The second catch region 160 is flanked, in the direction of travel A, by said guide region 100.

Figure 6:
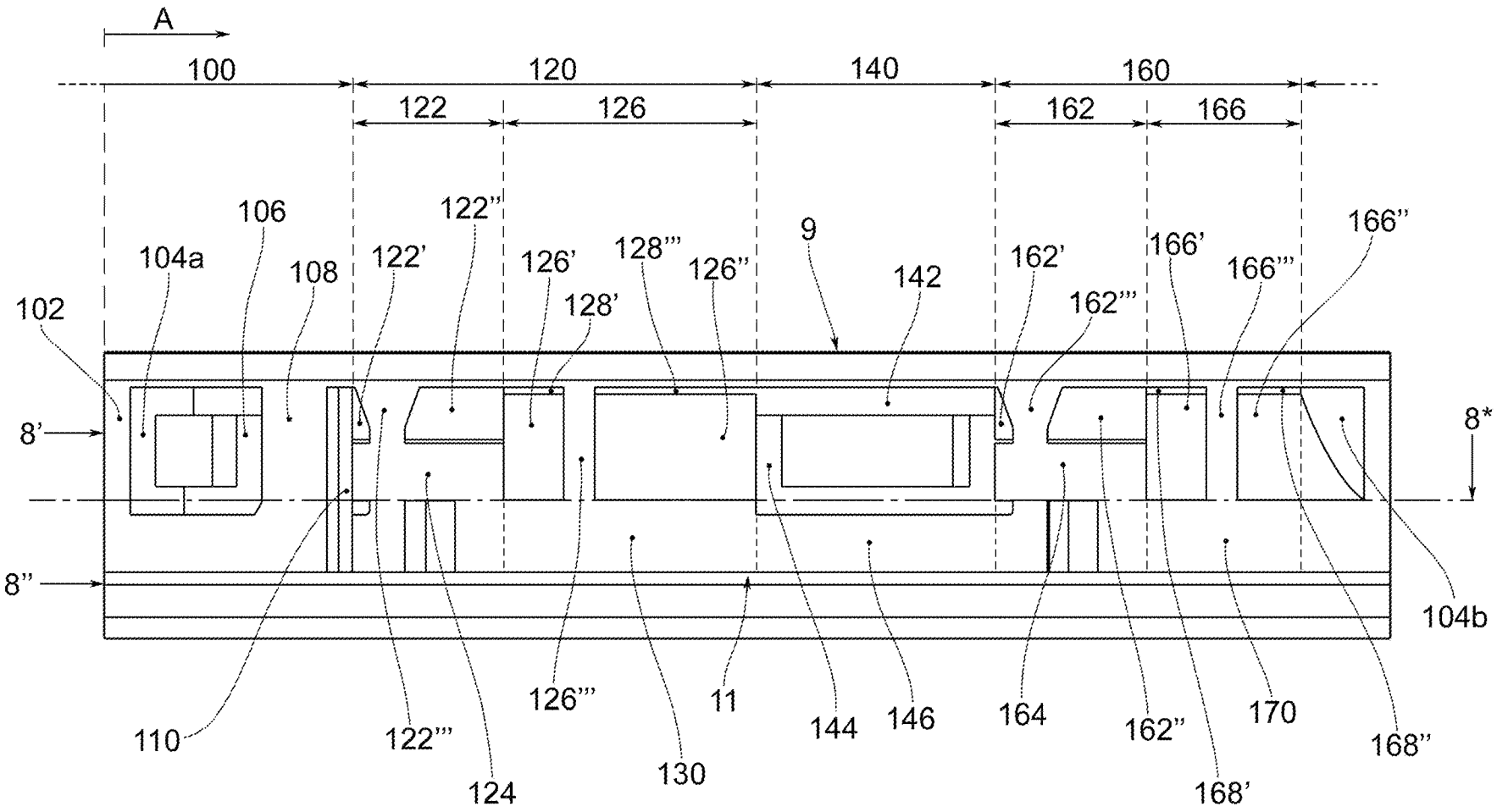
FIG. 6 shows a development in plan of the neck surface of the bottle according to the first embodiment of the invention.

FIG. 6 summarizes the structure of the neck 8, according to a development in plan of the surface.

Two-Catch Connection Skirt

Figure 7A:
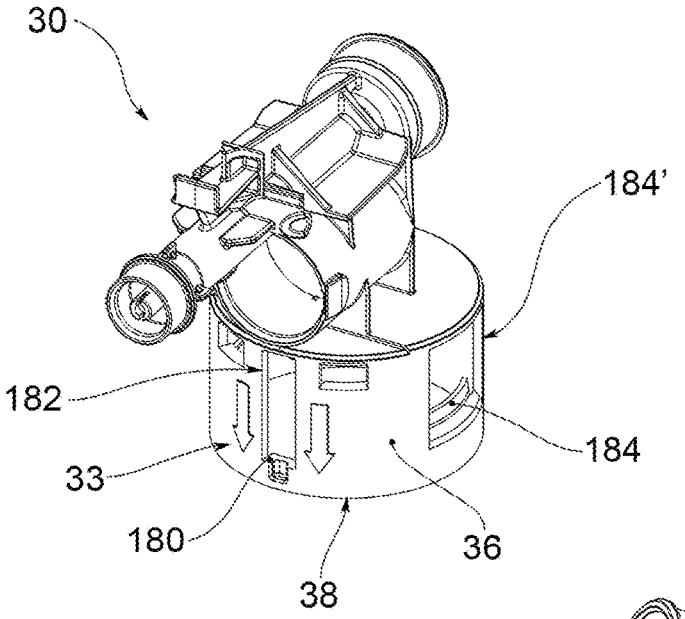
FIGS. 7*a* to 7*c* illustrate a frame of a trigger dispensing head of the dispensing device, according to the first embodiment of the invention, according to different observation points.
Figure 7B:
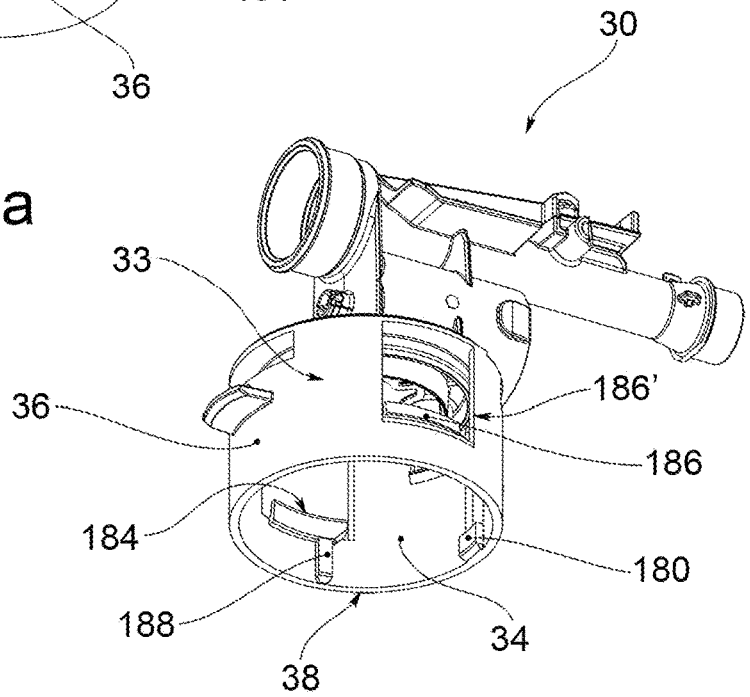
Figure 7C:
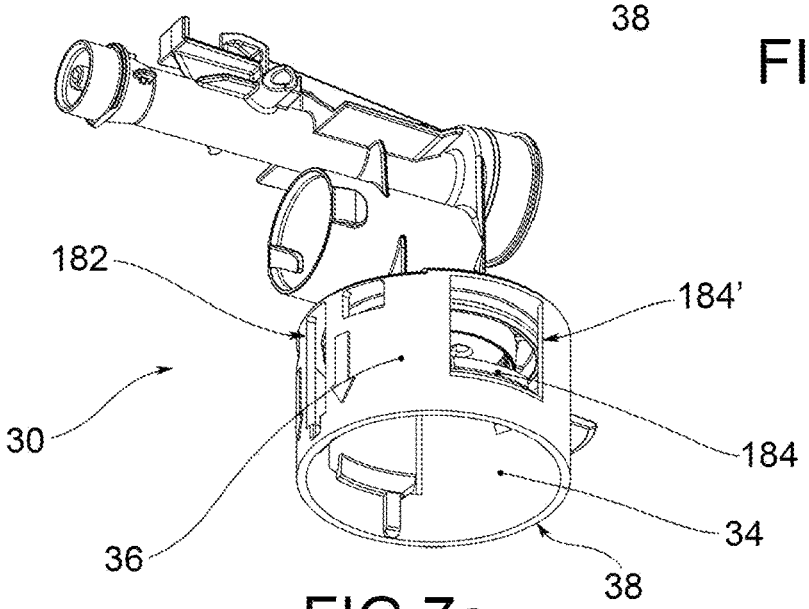

With reference to FIGS. 7*a*, 7*b* and 7*c*, the skirt 32 of the frame 30 comprises an annular skirt wall 33, having an inner side surface 34, an outer side surface 36 and a free skirt edge 38.

The skirt 32 comprises a reference tooth 180, substantially rigid, protruding from the inner surface 34.

Preferably, at the reference tooth 180, the skirt 32 has a reference window 182, passing through the skirt wall 33.

Additionally, the skirt 32 comprises a first flexible tab 184 and a second flexible tab 186, each having a predefined circumferential extension and protruding internally from the inner surface 34. For this reason, the present embodiment is referred to as "two-catch".

Preferably, at each tab 184, 186, the skirt 32 has a tab window 184', 186', passing through the skirt wall 33.

In addition, the skirt 32 comprises a first tab tooth 188 and a second tab tooth 190, each tab tooth having axial extension and protruding from the inner surface 34 of the skirt 32.

In particular, said tab teeth 188, 190 extend between the respective tab 184, 186 and the skirt edge 38 of the skirt wall 33.

The two tabs 184, 186, in such embodiment, are arranged in diametrically opposed positions, while the reference tooth 180 is placed in a position angularly equidistant between the two tabs 184, 186.

Operation of Two-Catch Connection

Figure 8B:
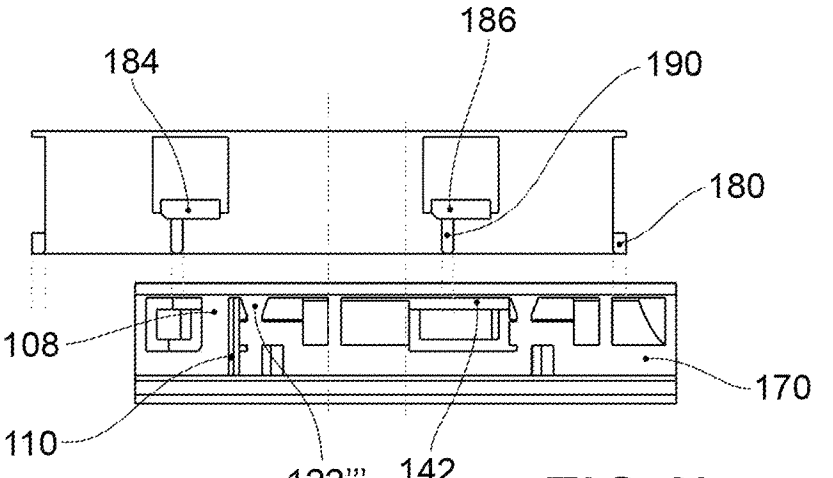
FIGS. 8*a* to 8*d* illustrate the development in plan of the outer surface of the neck of the bottle and the inner surface of a skirt of a frame of the dispensing head, in accordance with the first embodiment of the invention, in various relevant angular positions.
Figure 8D:
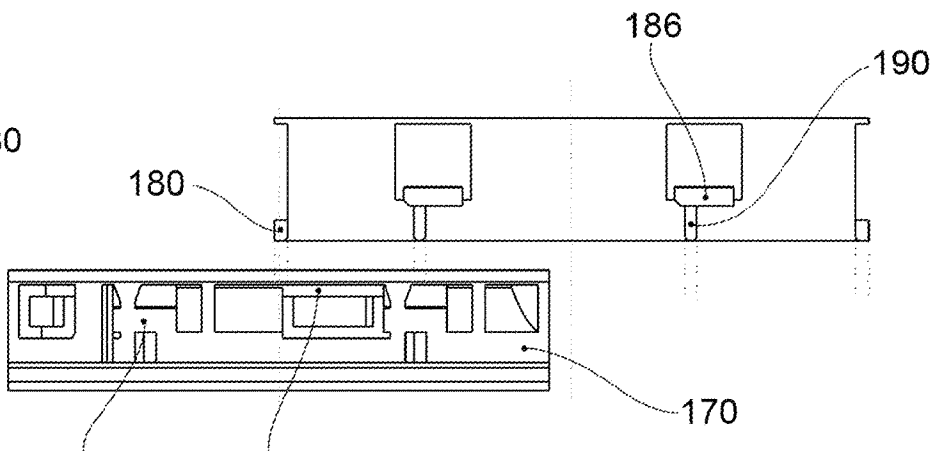
Figure 8A:
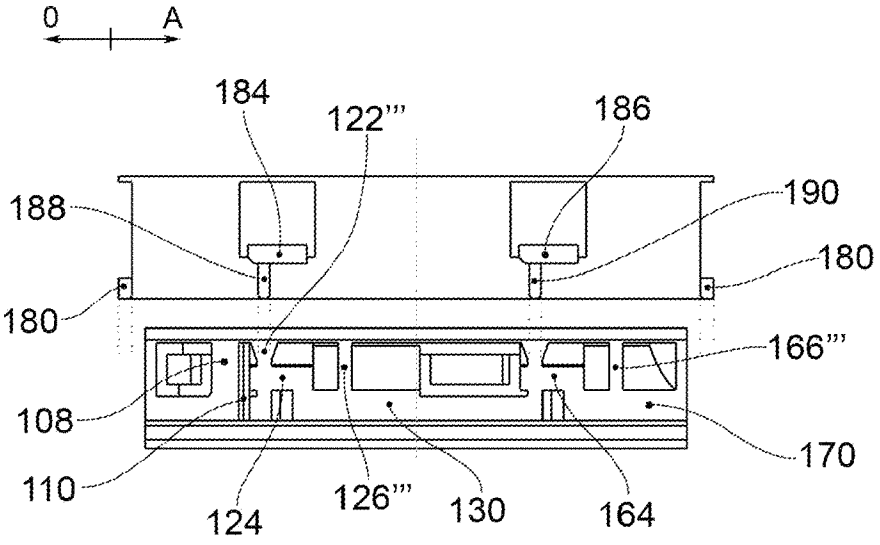

With reference to FIG. 8*a*, when the reference tooth 180 is aligned with the reference passage 102 of the neck 8, it follows that:

- the first tab tooth 188 is aligned with the first catch passage 122'" with a funnel-like mouth, and the first tab 184 is aligned with the first catch guide 122, and
- the second tab tooth 190 is aligned with the second catch entry passage 162'" with a funnel-like mouth, and the second tab 186 is aligned with the second catch guide 162.

This relevant angular arrangement defines an aligned engagement configuration, wherein the axial snap-engagement is possible.

For the relevant axial approach between neck and skirt, the reference tooth passes unobstructed in the reference passage 108, the tab teeth 188, 190 are unobstructed in the axial overlap with the neck 8, and the tabs 184, 186 deform in opposition with the guides 122, 162 and snap respectively in the first catch pocket 124 and in the second catch pocket 164 (engagement configuration).

Such engagement configuration corresponds to the correct alignment of the main tube 20 of the head 2 with the engagement opening 14 of the bottle.

From such engagement configuration, it is not possible to disengage the skirt 32 from the neck 8 by a simple axial detaching action, since the tabs 184, 186 are opposed by their respective guides 122, 162.

From such configuration, a rotation of the head 2 with respect to the neck 8 in a first direction, for example, clockwise O, does not have any effect, since at least one of the reference teeth 180 or the tab teeth 188, 190 abuts against a protuberance that cannot be surmounted.

For example, the first tab tooth 188 abuts against the reference rib 110.

A rotation of the head 2 with respect to the neck 8 in a second direction, for example, counterclockwise A, causes instead:

- the first tab tooth 188 to pass into the first catch corridor 130;
- the second tab tooth 190 to pass into the second catch corridor 170;
- the first tab 184 to pass onto the first catch slide 126 and the second tab 186 onto the second catch slide 166, the configuration of which leads to the axial disengagement.

Moreover, when the first tab 184 is brought into abutment against the shelf stop 144:

- the reference tooth 180 is aligned with the reference exit passage 108;
- the first tab tooth 188 is aligned with the first catch exit passage 126'"; and
- the second tab tooth 190 is aligned with the second catch exit passage 166'";

(aligned disengagement configuration).

In such configuration, by means of a relevant axial pulling action between head and neck, the two components disengage axially.

Figure 8C:
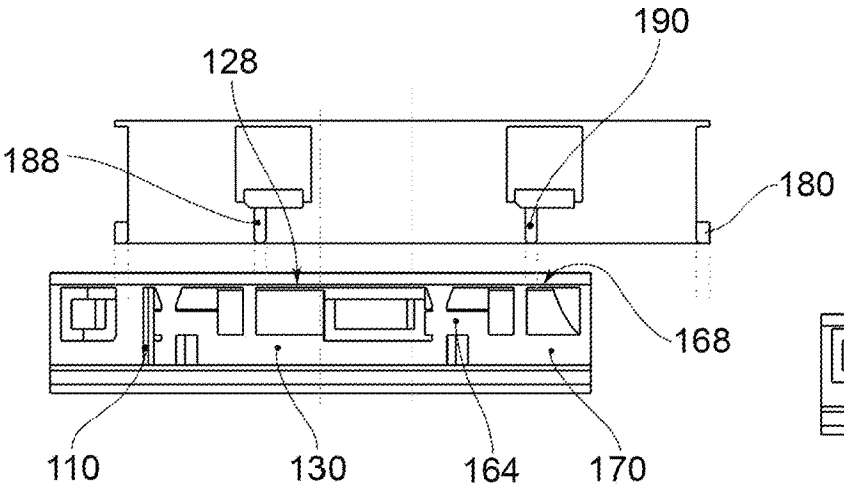

In any other relevant angular position between the skirt 32 and the neck 8, other than that of the aligned engagement configuration, the axial engagement is not possible, for various reasons, for example:

- because the second tab tooth 190 interferes with the upper shelf 142 (FIG. 8*b*); or
- because the tab teeth 188, 190 interfere with the respective slide abutments 128, 168 (FIG. 8*c*); or
- because the reference tooth 180 interferes with the upper shelf 142 (FIG. 8*d*).

Asymmetrical Three-Catch Connection

A further embodiment of the connection system provides for a three-catch connection, wherein two catches are arranged in diametrically opposed positions and the third catch is placed between the first two, in an equidistant position. Collectively, the three catches are therefore arranged asymmetrically, as they are 90° or 180° apart.

Asymmetrical Three-Catch Connection Neck

The neck 8 has externally a cylindrical circular outer surface 8*a* having a width equal to the distance between the free edge 9 and the annular flange 11.

For said outer surface 8*a*, an upper band 8' is defined, extending axially between the free edge 9 and an imaginary separation line 8*, and a lower band 8" extending from said separation line 8* to the annular flange 11. Preferably, said separation line 8* lies on a plane perpendicular to the main axis Z.

On the outer surface 8*a* of the neck 8 a guide region 200 is defined, comprising a circumferential section of the outer surface 8*a*.

Figure 9B:
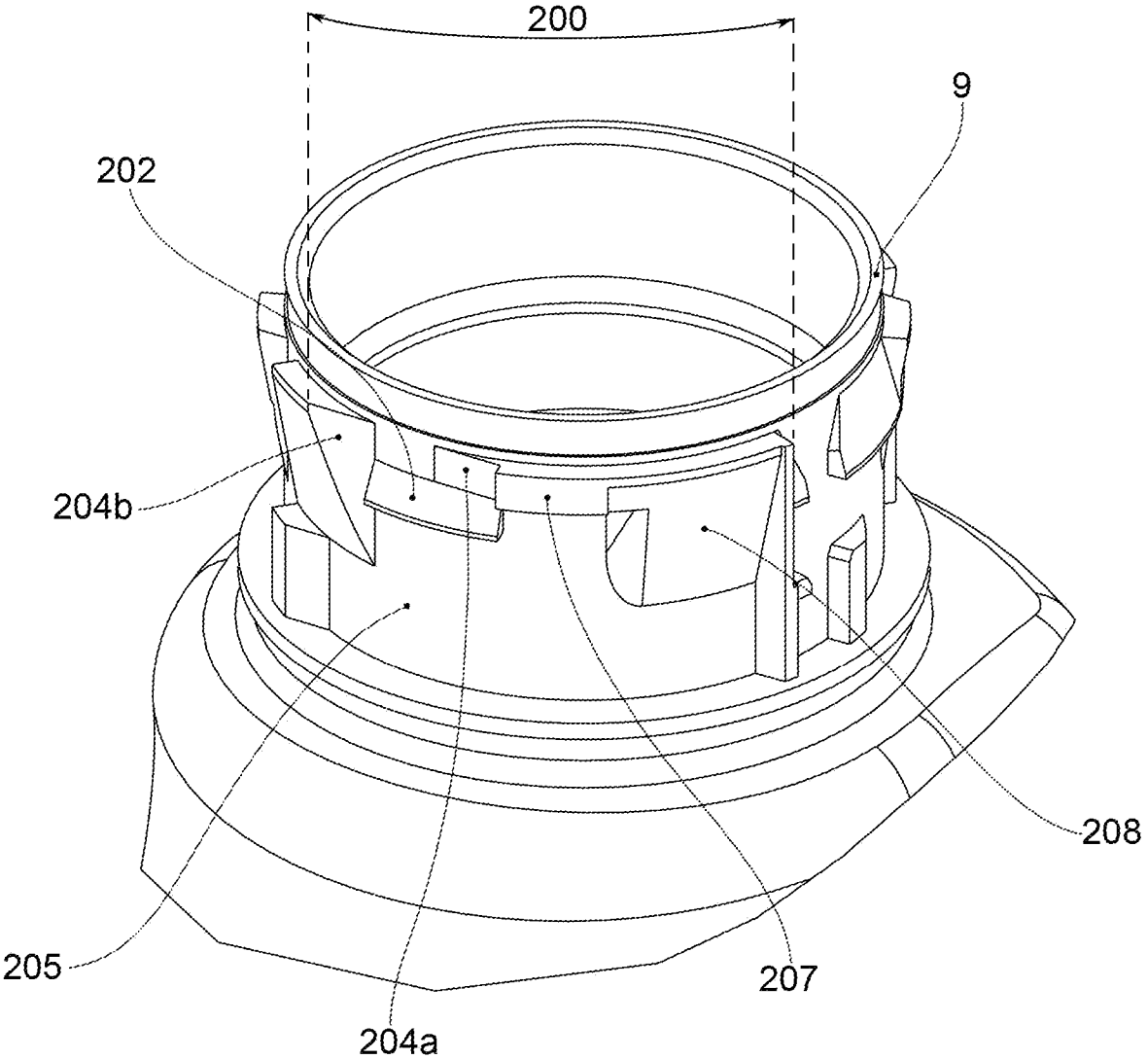
FIGS. 9*a* and 9*b* represent respectively a bottle of the dispensing device and an enlargement of a neck of the bottle, according to a second embodiment of the invention.
Figure 9A:
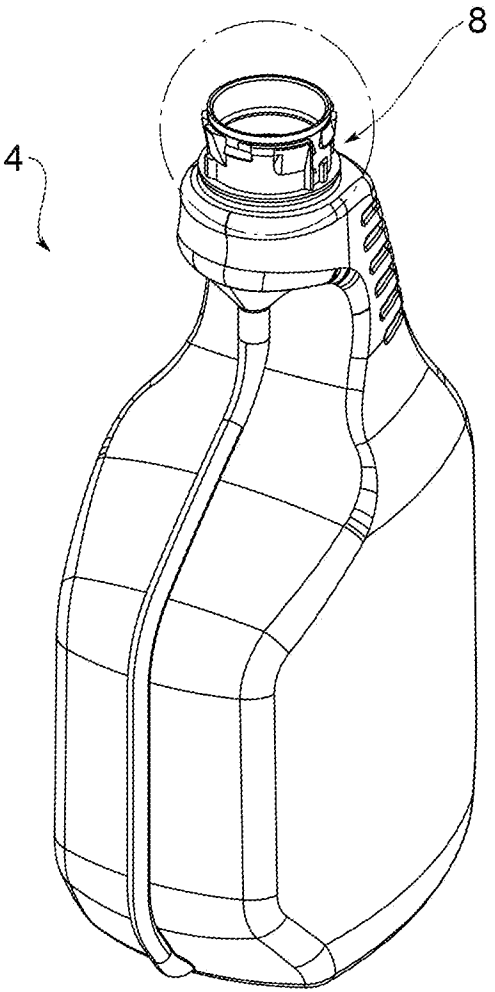

With reference to FIGS. 9*a* and 9*b*, the guide region 200 of the neck 8 has a reference guide 202, placed near the free edge 9, which defines a reference for the proper fitting of the head 2.

The reference guide 202 is flanked circumferentially by reference ramps 204*a*, 204*b*, proximal to the free edge 9 with respect to the reference guide entry 202, inclined towards said reference guide 202.

Preferably, in the direction of travel A, the guide region 100 has a reference shelf 207, proximal to the free edge 9 with respect to the entry of the reference guide 202.

The reference guide 202 extends only partially in the upper band 8', as does the reference shelf 207, so that between said reference guide 202 and the reference shelf 207 and the annular flange 11, a surface without ridges is formed, which constitutes a reference pocket 205.

The reference shelf 207 is flanked circumferentially by a reference slide 208, which extends mainly in the upper band 8', flanking circumferentially the reference pocket 205.

Still proceeding in the same direction of travel, the reference region 200 has a reference rib 210, flanking the reference slide 206.

Preferably, said reference rib 210 extends from the free edge 9 to the annular flange 11 and consists of a wall protruding from the outer surface 8*a*, having extension parallel to a generatrix of the cylindrical outer surface 8*a*.

The remaining part of the neck 8 is structurally and functionally similar to that described for the "two-catch" embodiment and in particular comprises:

- a first catch region 220, having a first catch guide 222 with two sloping walls 222', 222" separated circumferentially by a first catch entry passage 222'", a first catch pocket 224, a first catch slide 226 with two slide parts 226', 226" separated by a first catch exit passage 226'", a first catch slide abutment 228 in two abutment parts 228', 228", a first catch corridor 230;
- a shelf region 240 having an upper shelf 242, a shelf stop 244;
- a second catch region 260 having a second catch guide 262 with two sloping walls 262', 262" separated by a second catch entry passage 162'", a second catch pocket 264, a second catch slide 266 in two slide parts 266', 266" separated by a second catch exit passage 266'", with a second catch slide abutment 268, divided into two abutment parts 268', 268", a second catch corridor 270.

The second catch region 260 is flanked, in the direction of travel A, by said guide region 200.

Figure 10:
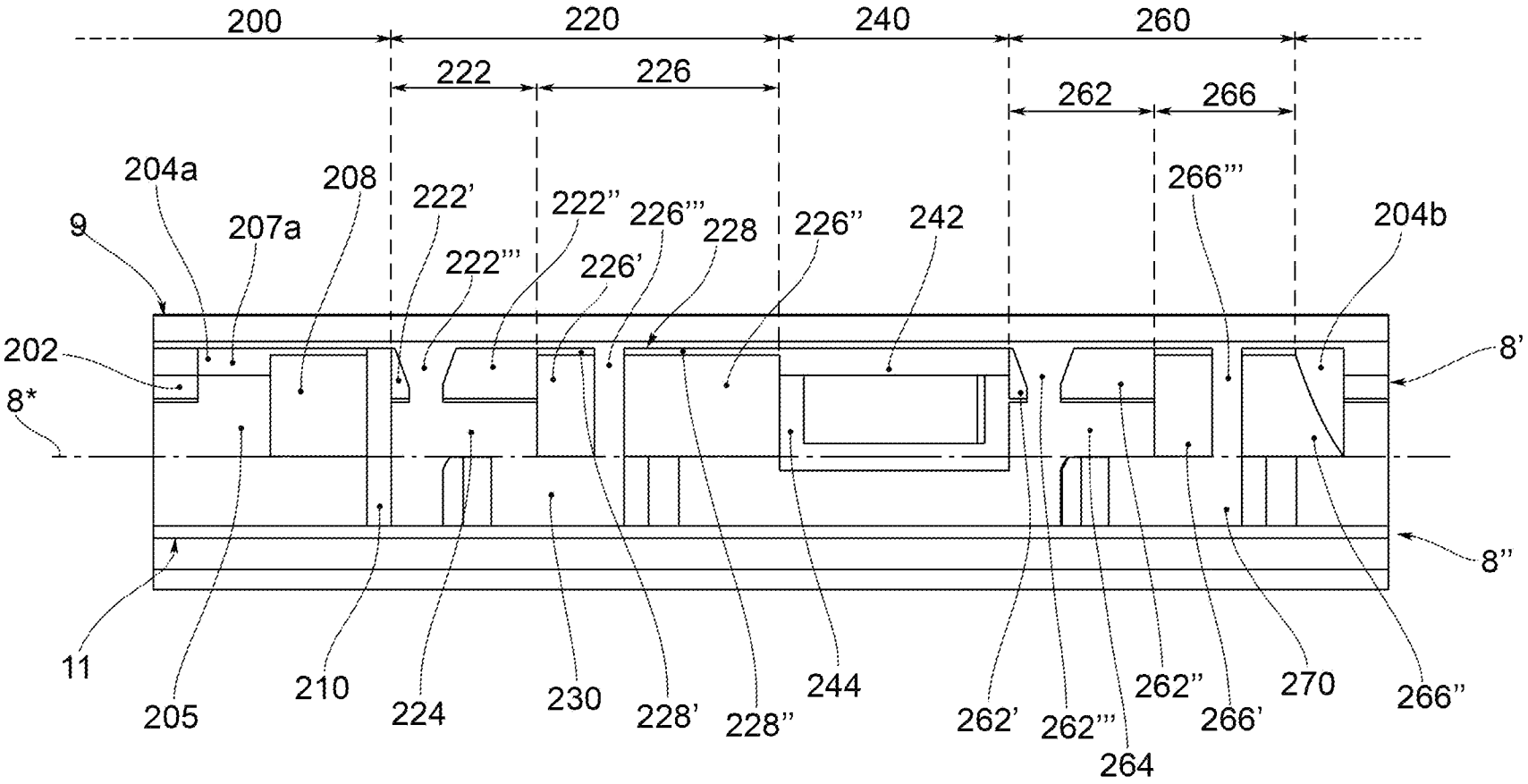
FIG. 10 shows a development in plan of the neck surface of the bottle according to the second embodiment of the invention.

FIG. 10 summarizes the structure of the neck 8, according to a development in plan of the surface.

Asymmetrical Three-Catch Connection Skirt

Figure 11A:
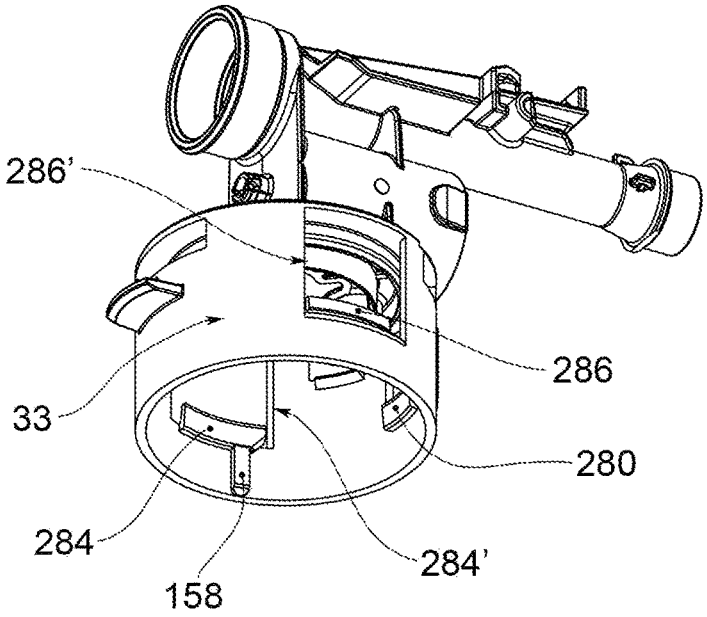
FIGS. 11*a* to 11*c* illustrate a frame of a trigger dispensing head of the dispensing device, according to the second embodiment of the invention, according to different observation points.
Figure 11B:
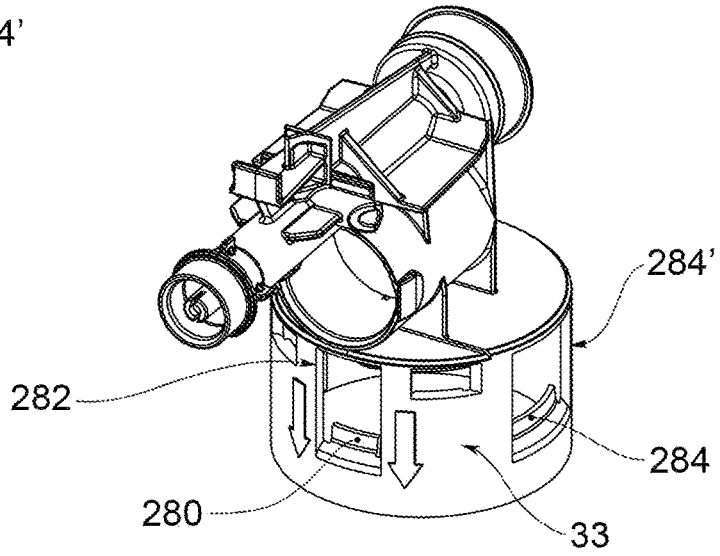
Figure 11C:
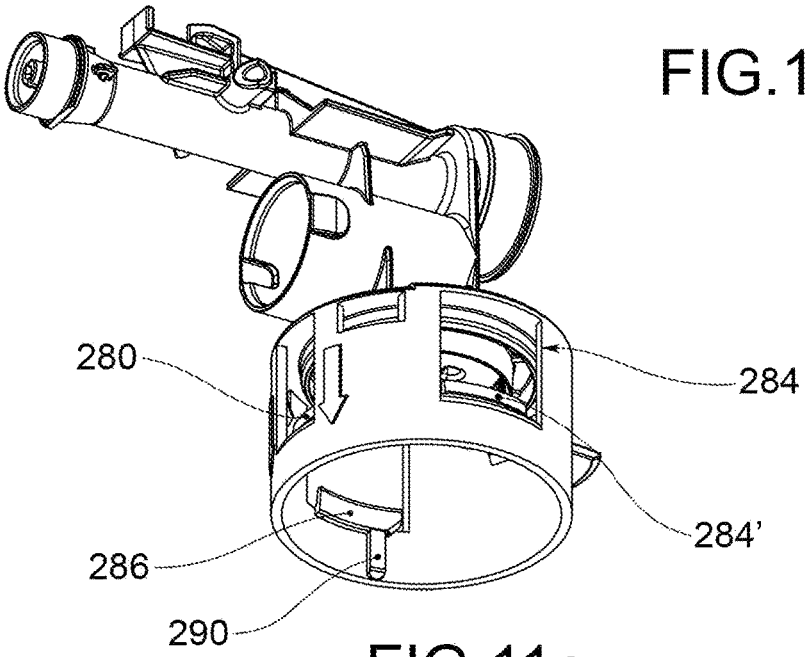

With reference to FIGS. 11*a*, 11*b* and 11*c*, the skirt 32 of the frame 30 comprises an annular skirt wall 33, having an inner side surface 34, an outer side surface 36 and a free skirt edge 38.

The skirt 32 comprises a flexible reference tab 280, protruding from the inner surface 34.

Preferably, at the reference tab 280, the skirt 32 has a reference window 282, passing through the skirt wall 33.

Additionally, the skirt 32 comprises a first flexible tab 284 and a second flexible tab 286, each having a predefined circumferential extension and protruding internally from the inner surface 34. For this reason, the present embodiment is referred to as "three-catch".

Preferably, at each tab 284, 286, the skirt 32 has a tab window 284', 286', passing through the skirt wall 33.

Moreover, the skirt 32 comprises a first tab tooth 288 and a second tab tooth 290, each tab tooth having axial extension and protruding from the inner surface 34 of the skirt 32.

In particular, said tab teeth 288, 290 extend between the respective tab 284, 286 and the skirt edge 38 of the skirt wall 33.

The two tabs 284, 286, in such embodiment, are arranged in diametrically opposed positions, whereas the reference tab 280 is placed in a position angularly equidistant between the two tabs 284, 286.

Operation of Asymmetrical Three-Catch Connection

Figure 12B:
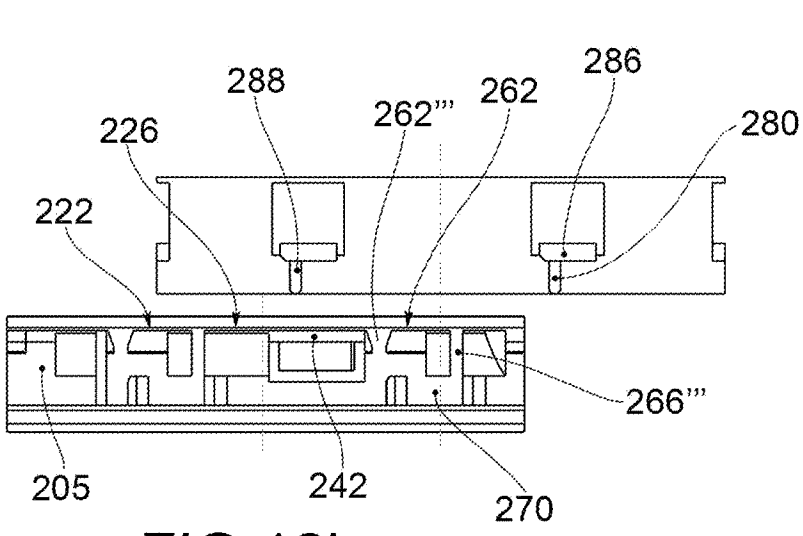
FIGS. 12*a* to 12*d* illustrate the development in plan of the outer surface of the neck of the bottle and the inner surface of a skirt of a frame of a dispensing head, in accordance with the second embodiment of the invention, in various relevant angular positions.
Figure 12A:
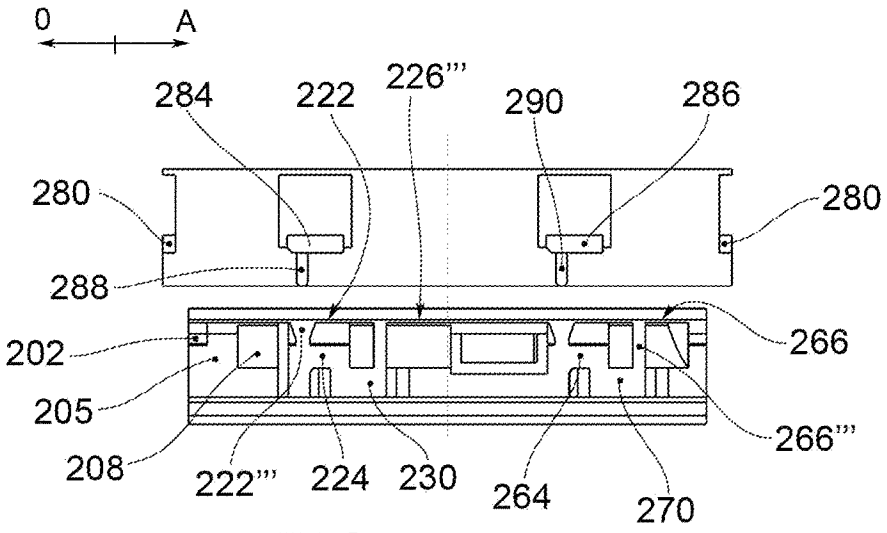

With reference to FIG. 12*a*, when the reference tab 280 is aligned with the reference guide 202 of the neck 8, it follows that:

- the first tab tooth 288 is aligned with the first catch passage 222'" with a funnel-like mouth, and the first tab 284 is aligned with the first catch guide 222, and
- the second tab tooth 290 is aligned with the second catch entry passage 262'" with a funnel-like mouth, and the second tab 286 is aligned with the second catch guide 262 (aligned engagement configuration).

In this relevant position, the engagement between the skirt 32 and the neck 8 is possible, since the tab teeth 288, 290 are unobstructed in the axial overlap with the neck 8 and the reference tab 280 and the tabs 284, 286 deform in opposition with the respective guides 202, 222, 262 and snap respectively into the reference pocket 205, into the first catch pocket 224 and into the second catch pocket 264 (engagement configuration).

Such engagement configuration corresponds to the correct alignment of the main tube 20 of the head 2 with the engagement opening 14 of the bottle.

From such engagement configuration, it is not possible to disengage the skirt 32 from the neck 8 by simple axial detaching action, as the tabs 280, 284, 286 are opposed by their respective guides 202, 222, 262.

From such configuration, a rotation of the head 2 with respect to the neck 8 in a first direction, for example, clockwise O, does not have any effect, since at least one of the tab teeth 288, 290 abuts against a protuberance that cannot be surmounted.

For example, the first tab tooth 288 abuts against the reference rib 210.

A rotation of the head 2 with respect to the neck 8 in a second direction, for example, counterclockwise A, causes instead:

- the reference tab 280 to pass onto the reference slide 208;
- the first tab tooth 288 to pass into the first catch corridor 230;
- the second tab tooth 290 to pass into the second catch corridor 270;

the first tab 284 to pass onto the first catch slide 226 and the second tab 286 onto the second catch slide 266, the configuration of which leads to the axial disengagement.

Moreover, the reference tab 280 is brought into abutment against the reference rib 210:

the first tab tooth 288 is aligned with the first catch exit passage 226'''; and the second tab tooth 290 is aligned with the second catch exit passage 266'''; (aligned disengagement configuration).

In such configuration, by means of a relevant axial pulling action between the head and the neck, the two components disengage axially since the tabs 280, 284, 286 deform by sliding over their respective slides 208, 226, 266.

Figure 12D:
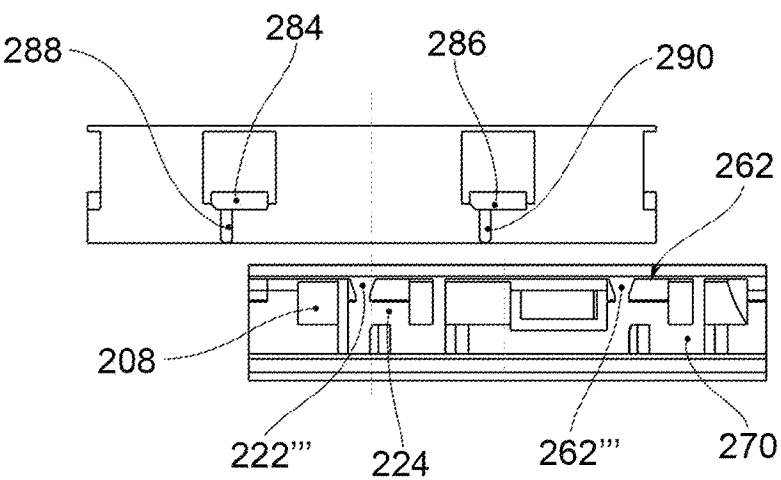
Figure 12C:
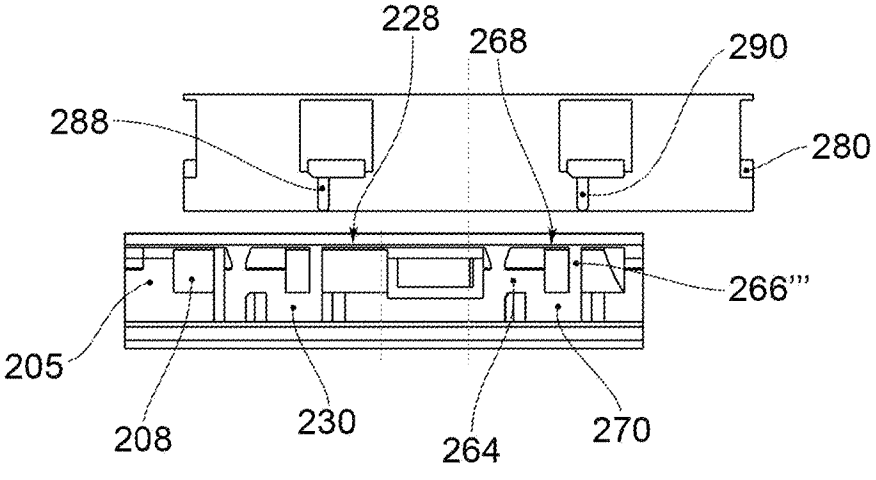

In any other relevant angular position between the skirt 32 and the neck 8, other than the aligned engagement configuration, the axial engagement is not possible, for various reasons, for example:

because the first tab tooth 288 interferes with the upper shelf 242 (FIG. 12*b*); or because the tab teeth 288, 290 interfere with the respective slide abutments 228, 268 (FIG. 12*c*); or because the second tab tooth 290 interferes with the first catch slide abutment 228 (FIG. 12*d*).

Symmetrical Three-Catch Connection

A further embodiment of the connection system provides for a three-catch connection arranged angularly equidistant, i.e. spaced 120° apart. Such catches are therefore arranged symmetrically.

Symmetrical Three-Catch Connection Neck

The neck 8 has externally a circular cylindrical outer surface 8*a* having a width equal to the distance between the free edge 9 and the annular flange 11.

For said outer surface 8*a*, an upper band 8' is defined, which extends axially between the free edge 9 and an imaginary separation line 8*, and a lower band 8" that extends from said separation line 8* to the annular flange 11. Preferably, said separation line 8* lies on a plane perpendicular to the main axis Z.

On the outer surface 8*a* of the neck 8 a guide region 300 is defined, which comprises a circumferential section of the outer surface 8*a*.

Figure 13B:
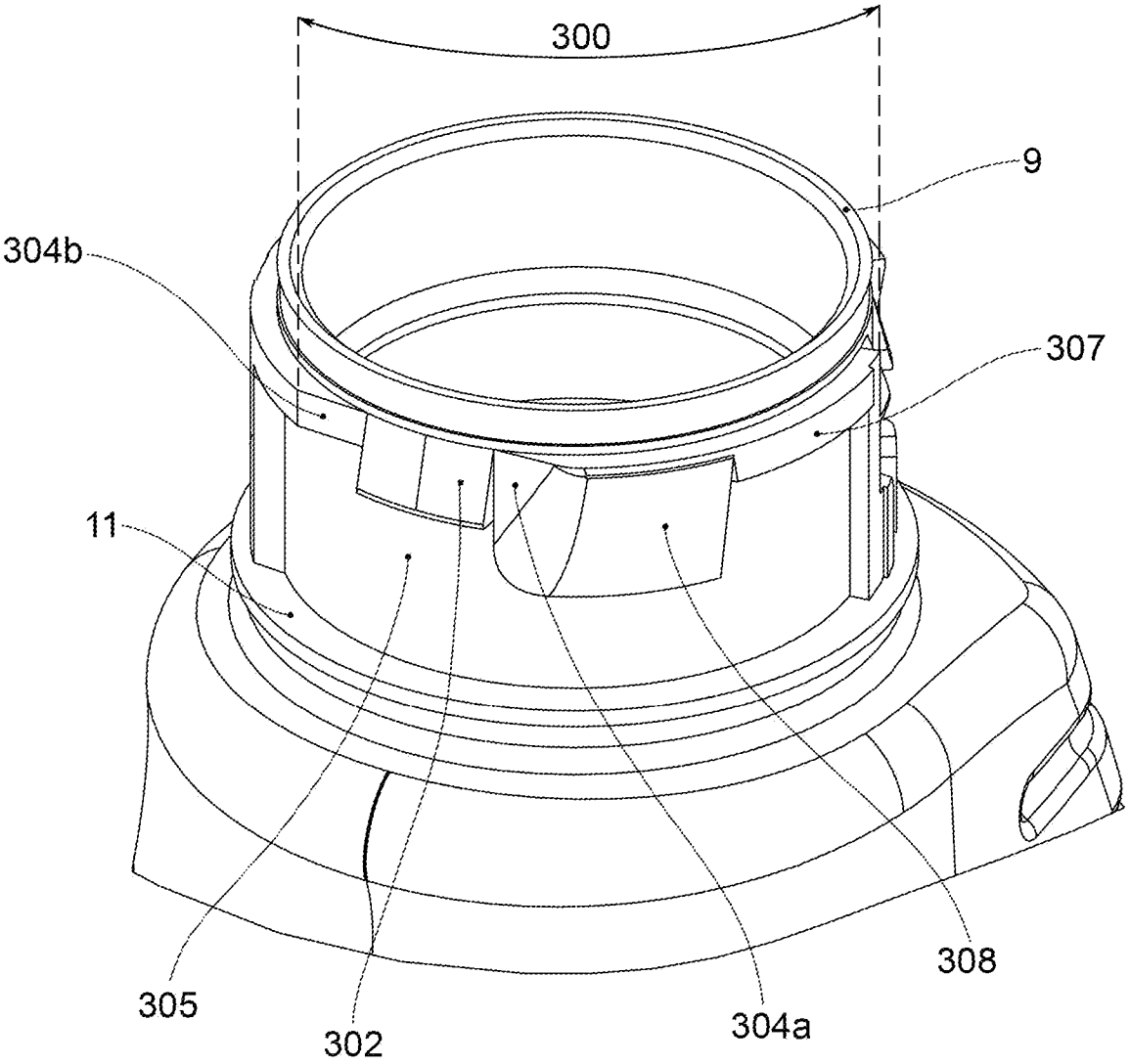
FIGS. 13*a* and 13*b* represent respectively a bottle of the dispensing device and an enlargement of a neck of the bottle, according to a third embodiment of the invention.
Figure 13A:
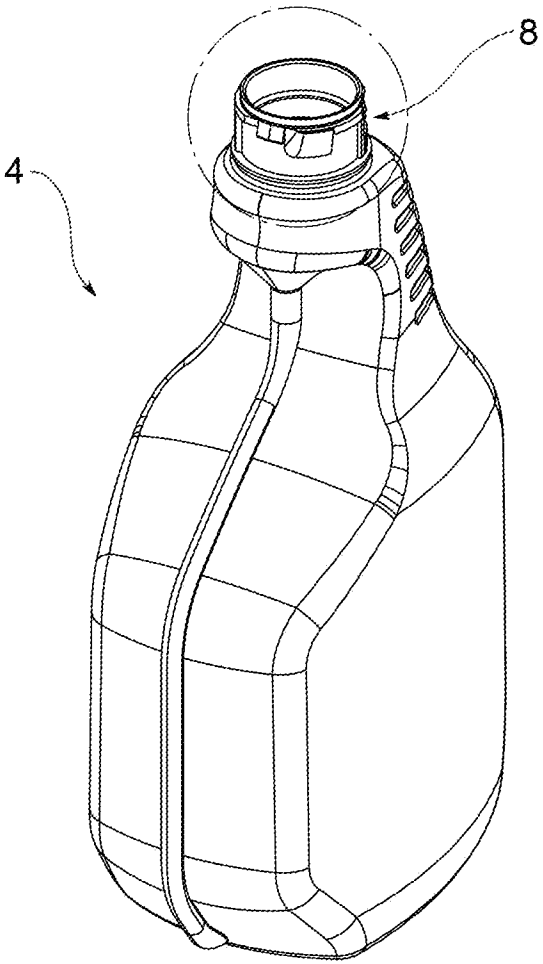

With reference to FIGS. 13*a* and 13*b*, the guide region 300 of the neck 8 has a reference guide 302, placed near the free edge 9, which defines a reference for the correct application of the head 2.

The reference guide 302 extends only partially in the upper band 8', thus leaving a region without ridges that constitutes a guide pocket 305.

The reference guide 302 is flanked circumferentially by a reference slide 308, which extends mainly in the upper band 8', flanking circumferentially the reference pocket 305.

Preferably, part of the reference slide 308 forms a guide ramp 304*a* inclined towards the reference guide 302; on the opposite side to the guide ramp 304*a*, the reference guide 302 is flanked by an additional guide ramp 304*b*.

Preferably, in the direction of travel A, the guide region 300 has a reference shelf 307, preferably aligned with the reference slide 308.

Still proceeding in the same direction of travel, the reference region 300 has a reference rib 310, flanking the reference shelf 307.

Preferably, said reference rib 310 extends from the free edge 9 to the annular flange 11 and consists of a wall protruding from the outer surface 8*a*, having extension parallel to a generatrix of the cylindrical outer surface 8*a*.

The remaining part of the neck 8 is structurally and functionally similar to that described for the embodiment with "two-catch connection" and with "asymmetrical three-catch connection", and in particular comprises:

a first catch region 320, having a first catch guide 322 with two sloping walls 322', 322" separated circumferentially by a first catch entry passage 322''', a first catch pocket 324, a first catch slide 326 with two slide parts 326', 326" separated by a first catch exit passage 326''', a first catch slide abutment 328 in two abutment parts 328', 328", a first catch corridor 330.

Preferably, in the first catch exit passage 326''' a first tooth slide 329 is provided.

It is further provided that:

a shelf region 340 having an upper shelf 342, a shelf stop 344;

a second catch region 360 having a second catch guide 362 with two sloping walls 362', 362" separated by a second catch entry passage 362''', a second catch pocket 364, a second catch slide 366 in two slide parts 366', 366" separated by a second catch entry passage 366''', with a second catch slide abutment 368, divided into two abutment parts 368', 368", a second catch corridor 370.

Preferably, in the second catch exit passage 366''' a second tooth slide 367 is provided.

The second catch region 360 is flanked, in the direction of travel A, by a further shelf region 370 having a further upper shelf 372 and a further shelf stop 374.

The further shelf region 370 is flanked, in the direction of travel A, by said guide region 300.

Figure 14:
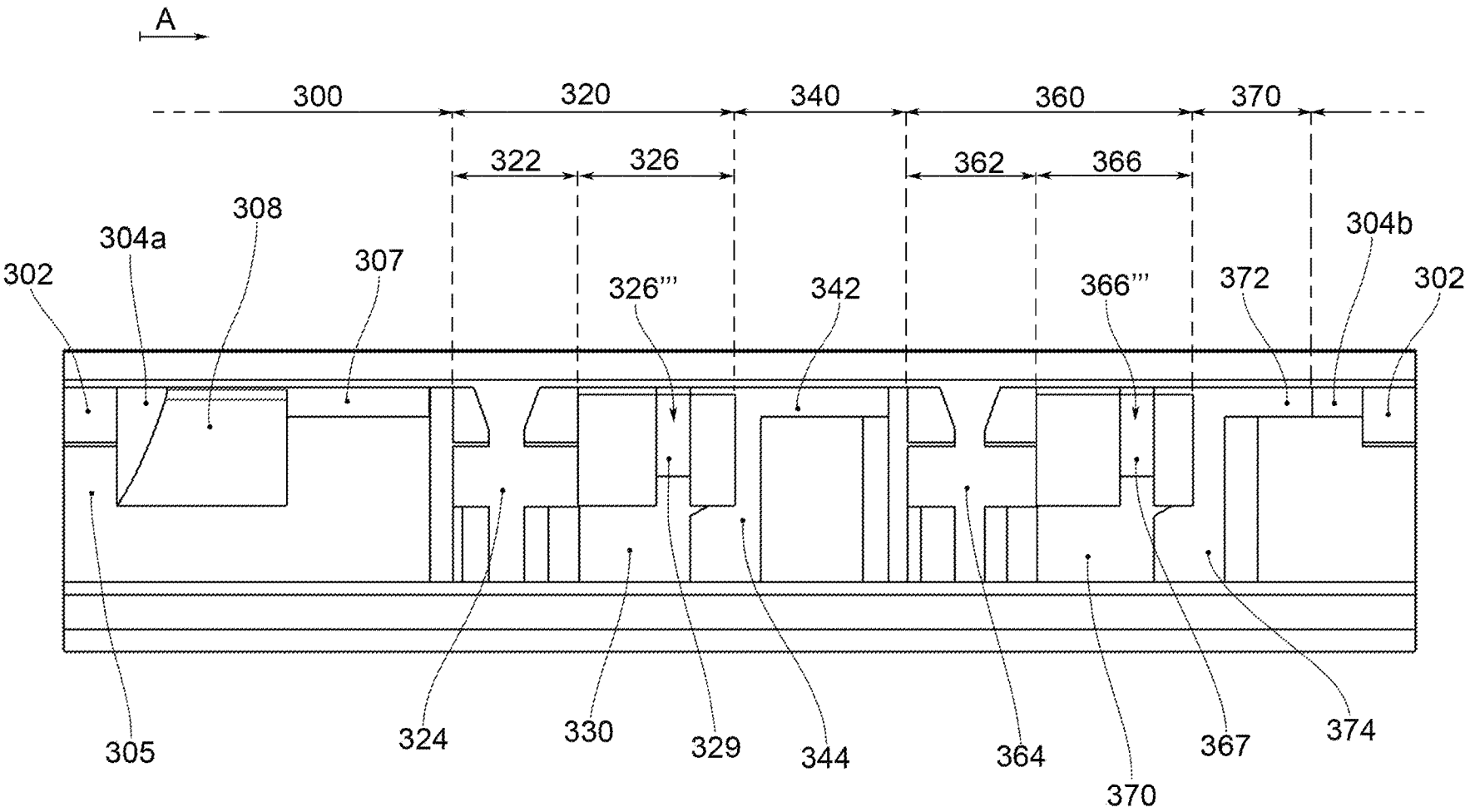
FIG. 14 shows a development in plan of the neck surface of the bottle according to the third embodiment of the invention.

FIG. 14 summarizes the structure of the neck 8, according to a development in plan of the surface.

Symmetrical Three-Catch Connection Skirt

Figure 15A:
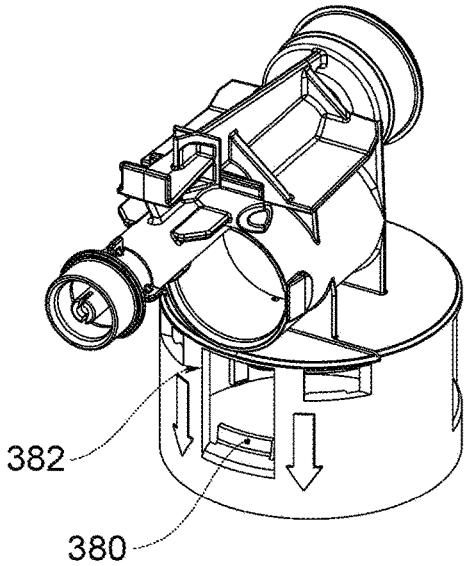
FIGS. 15*a* to 15*c* illustrate a frame of a trigger dispensing head of the dispensing device, according to the third embodiment of the invention, according to different observation points.
Figure 15B:
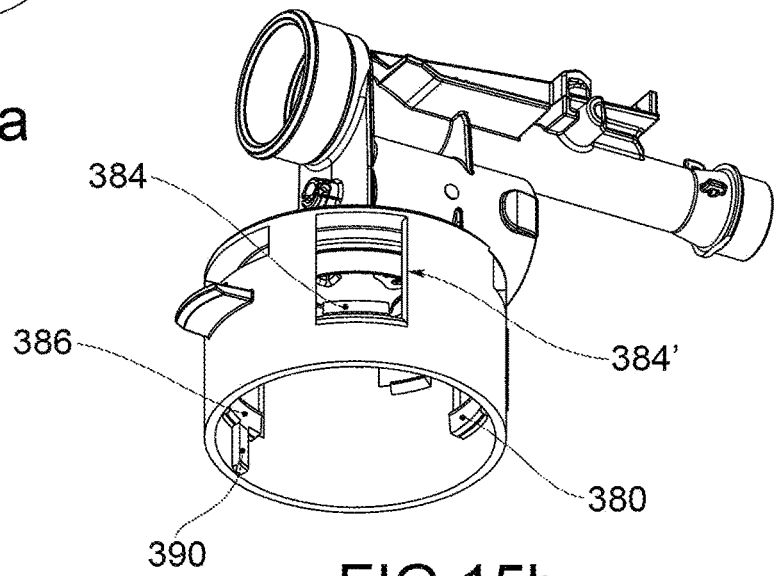
Figure 15C:
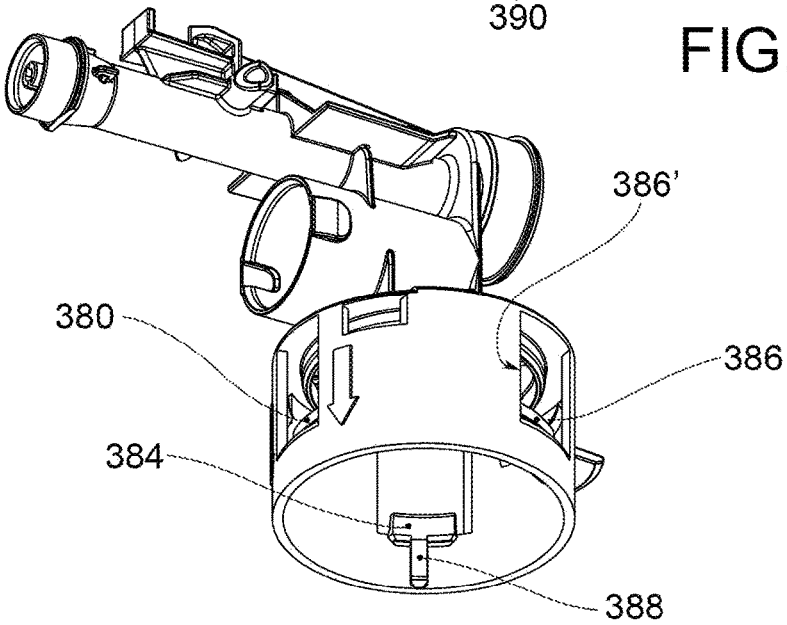

With reference to FIGS. 15*a*, 15*b* and 15*c*, the skirt 32 of the frame 30 comprises an annular skirt wall 33, having an inner side surface 34, an outer side surface 36 and a free skirt edge 38.

The skirt 32 comprises a flexible reference tab 380, protruding from the inner surface 34.

Preferably, at the reference tab 380, the skirt 32 has a reference window 382, passing through the skirt wall 33.

Additionally, the skirt 32 comprises a first flexible tab 384 and a second flexible tab 386, each having a predefined circumferential extension and protruding internally from the inner surface 34. For this reason, the present embodiment is referred to as "three-catch".

Preferably, at each tab 384, 386, the skirt 32 has a tab window 384', 386', passing through the skirt wall 33.

In addition, the skirt 32 comprises a first tab tooth 388 and a second tab tooth 390, each tab tooth having axial extension and protruding from the inner surface 34 of the skirt 32.

In particular, said tab teeth 388, 390 extend between the respective tab 384, 386 and the skirt edge 38 of the skirt wall 33.

The two tabs 384, 386 and the reference tab 380 are equally spaced angularly.

Operation of Asymmetrical Three-Catch Connection

Figure 16B:
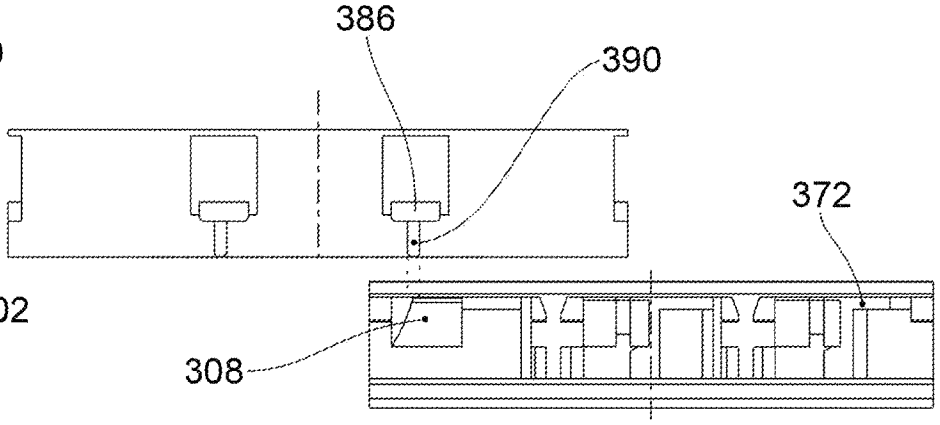
FIGS. 16*a* to 16*d* illustrate the development in plan of the outer surface of the neck of the bottle and the inner surface of a skirt of a frame of a dispensing head, in accordance with the third embodiment of the invention, in various relevant angular positions.
Figure 16D:
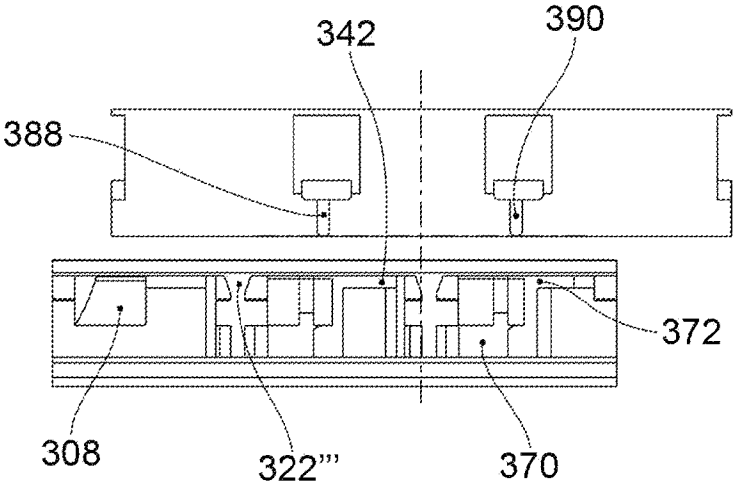
Figure 16A:
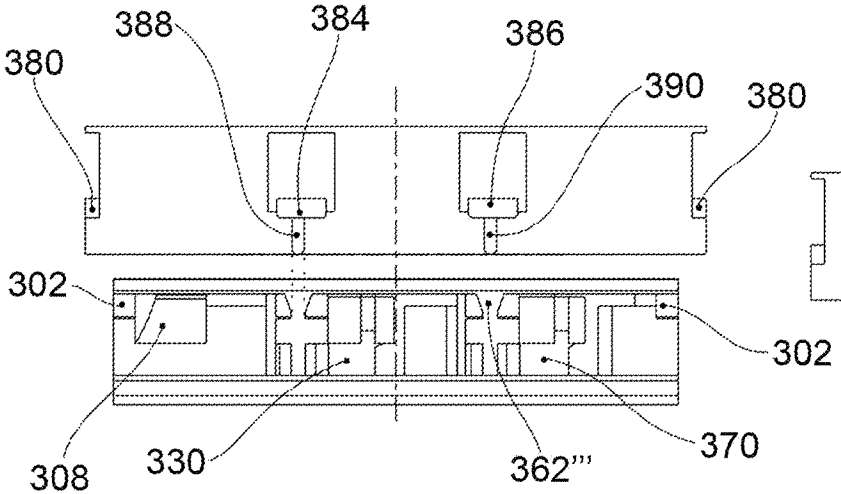

With reference to FIG. 16*a*, when the reference tab 380 is aligned with the reference guide 302 of the neck 8, it follows that:

the first tab tooth 388 is aligned with the first catch passage 322''' with a funnel-like mouth, and the first tab 384 is aligned with the first catch guide 322, and the second tab tooth 390 is aligned with the second catch entry passage 362''' with a funnel-like mouth, and the second tab 386 is aligned with the second catch guide 362 (aligned engagement configuration).

In this relevant position, the engagement between the skirt 32 and the neck 8 is possible, since the tab teeth 388, 390 are unobstructed in the axial overlap with the neck 8 and the reference tab 380, and the tabs 384, 386 deform in opposition with the respective guides 302, 322, 362 and snap respectively into the reference pocket 305, in the first catch pocket 324 and in the second catch pocket 364 (engagement configuration).

Such engagement configuration corresponds to the correct alignment of the main tube 20 of the head 2 with the engagement opening 14 of the bottle.

From such engagement configuration, it is not possible to disengage the skirt 32 from the neck 8 by simple axial detaching action, as the tabs 380, 384, 386 are opposed by their respective guides 302, 322, 362.

From such configuration, a rotation of the head 2 with respect to the neck 8 in a first direction, for example, clockwise O, does not have any effect, since at least one of the tab teeth 388, 390 abuts against a protuberance that cannot be surmounted.

A rotation of the head 2 with respect to the neck 8 in a second direction, for example, counterclockwise A, causes instead:

the reference tab 380 to pass onto the reference slide 308;

the first tab tooth 388 to pass into the first catch corridor 330;

the second tab tooth 390 to pass into the second catch corridor 370;

the first tab 384 to pass onto the first catch slide 326 and the second tab 386 onto the second catch slide 366, the configuration of which leads to the axial disengagement.

In addition, after one of said tab teeth 388, 390 are brought in abutment against the respective shelf stop 344, 374:

the first tab tooth 288 is aligned with the first catch exit passage 226''', facilitated in exiting from the first tooth slide 329; and the second tab tooth 390 is aligned with the second catch exit passage 366''', facilitated in exiting from the second tooth slide 367; (aligned disengagement configuration).

In such configuration, by means of a relevant axial pulling action between the head and the neck, the two components disengage axially, since the tabs 380, 384, 386 deform by sliding over their respective slides 308, 326, 366.

Figure 16C:
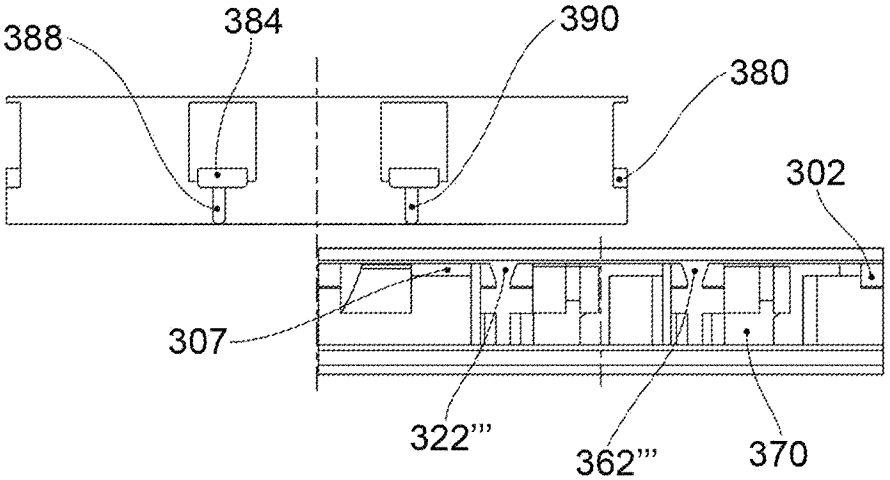

In any other relevant angular position between the skirt 32 and the neck 8, other than the aligned engagement configuration, the axial engagement is not possible, for various reasons, for example:

because the second tab tooth 390 interferes with the reference shelf 307 (FIG. 16*b*); or the second tab tooth 39 interferes with the reference slide 308 (FIG. 16*c*); or the tab teeth 388, 390 interfere with the upper shelf 342 or with the additional upper shelf 372 (FIG. 16*d*).

O

Innovatively, the connection system according to the present invention overcomes the drawbacks mentioned above, in that the engagement between the dispensing head and the bottle is only possible in a predefined relevant angular position, which corresponds to the alignment of the tube with the engagement opening.

It is clear that one skilled in the art, in order to meet contingent needs, may make changes to the connection system described above, all contained within the scope of protection defined by the following claims.

What is claimed is:

1. A connection system between a trigger dispensing head and a bottle of a dispensing device, the connection system comprising:

a neck of the bottle having a circular cylindrical outer surface on which are defined:

A) a reference region having a reference passage or a reference guide for a snap-engagement;

B) a first catch region circumferentially flanking the reference region, provided with a first catch guide, having a first catch entry passage, and a first catch slide having a first catch exit passage;

C) a shelf region circumferentially flanking the first catch region, provided with an upper shelf; and D) a second catch region circumferentially flanking the shelf region, provided with a second catch guide, having a second catch entry passage, and a second catch slide having a second catch exit passage; and a skirt of the dispensing head comprising a skirt wall having a free skirt edge, comprising:

a) a rigid reference tooth or a flexible reference tab;

b) a first flexible tab and a first tab tooth located near the first flexible tab between the first flexible tab and the skirt edge; and c) a second flexible tab and a second tab tooth, located near the second flexible tab, between the second flexible tab and the skirt edge;

wherein exclusively in one predetermined angular position between the neck and the skirt, wherein i) the rigid reference tooth is aligned with the reference passage or the flexible reference tab is aligned with the reference guide, an axial snap-engagement between the skirt and the neck is allowed, defining an aligned engagement configuration.

2. The connection system of claim 1, wherein in any other relevant angular position between the neck and the skirt beyond the aligned engagement configuration, ii) the rigid reference tooth and/or the first tab tooth and/or the second tab tooth interfere axially with a ridge of the neck, which prevents the axial snap-engagement between the skirt and neck, defining non-aligned configurations.

3. The connection system of claim 2, wherein, in a nonaligned configuration, the rigid reference tooth interferes with the first catch slide or the upper shelf or the second catch slide.

4. The connection system of claim 2, wherein, in a nonaligned configuration, the first tab tooth interferes with the first catch slide or the upper shelf or the second catch slide.

5. The connection system of claim 2, wherein, in a nonaligned configuration, the second tab tooth interferes with the first catch slide or the upper shelf or the second catch slide.

6. The connection system of claim 1, wherein the reference passage is circumferentially flanked by reference ramps inclined towards the reference passage, to guide alignment during axial engagement.

7. The connection system of claim 1, wherein the reference guide is circumferentially flanked by reference ramps inclined towards the reference guide, to guide alignment during axial engagement.

8. The connection system of claim 1, wherein the first catch guide is separated into two parts by the first catch entry passage.

9. The connection system of claim 1, wherein the first catch slide is separated into two parts by the first catch exit passage.

10. The connection system of claim 1, wherein the second catch guide is separated into two parts by the second catch entry passage.

11. The connection system of claim 1, wherein the second catch slide is separated into two parts by the second catch exit passage.

12. The connection system of claim 1, wherein at the first catch guide, a first catch pocket is configured to receive the first flexible tab in an engagement configuration of the connection system, adjacent to the first catch slide.

13. The connection system of claim 1, wherein at the second catch guide, a second catch pocket is configured to receive the second flexible tab in an engagement configuration of the connection system, adjacent to the second catch slide.

14. The connection system of claim 1, wherein, from the engagement configuration of the connection system, by relevant rotation between the neck and skirt, an aligned disengagement configuration is achieved, wherein the rigid reference tooth and/or the flexible reference tab abut against a reference rib; or the first flexible tab abuts against the first catch slide and/or the second tab flexible abuts against the second catch slide.

15. The connection system of claim 14, wherein, in the aligned disengagement configuration, the rigid reference tooth is aligned with a reference exit passage of the reference region;

the first tab tooth is aligned with the first catch exit passage; and the second tab tooth is aligned with the second catch exit passage.

16. A dispensing device comprising:

a trigger dispensing head comprising a frame provided with a skirt and a main tube;

a bottle having a neck with central axis (Z) and an engagement opening for engagement with said main tube, offset from said central axis (Z); and the connection system of claim 1, wherein, in the aligned engagement configuration, an end portion of the main tube is aligned for engagement with the engagement opening.

* * * * *